US012264674B2

(12) United States Patent
Ge et al.

(10) Patent No.: US 12,264,674 B2
(45) Date of Patent: Apr. 1, 2025

(54) AXIALLY FLEXIBLE COMPRESSOR

(71) Applicant: Hangzhou Lvneng New Energy Vehicle Parts Co., LTD., Hangzhou (CN)

(72) Inventors: Dawei Ge, Hangzhou (CN); Jun Ouyang, Hangzhou (CN)

(73) Assignee: HANGZHOU LVNENG NEW ENERGY VEHICLE PARTS CO., LTD., Hangzhou (CN)

( * ) Notice: Subject to any disclaimer, the term of this patent is extended or adjusted under 35 U.S.C. 154(b) by 2 days.

(21) Appl. No.: 18/496,833

(22) Filed: Oct. 27, 2023

(65) Prior Publication Data

US 2024/0141897 A1 May 2, 2024

(30) Foreign Application Priority Data

Oct. 28, 2022 (CN) ..... 202211331124.9

(51) Int. Cl.
*F04C 18/02* (2006.01)
*F04C 23/00* (2006.01)
*F04C 27/00* (2006.01)

(52) U.S. Cl.
CPC ..... *F04C 27/001* (2013.01); *F04C 18/0215* (2013.01); *F04C 18/0253* (2013.01);
(Continued)

(58) Field of Classification Search
CPC ..... F04C 18/0215; F04C 18/0253; F04C 18/0261; F04C 23/008; F04C 27/005;
(Continued)

(56) References Cited

U.S. PATENT DOCUMENTS 4,696,630 A * 9/1987 Sakata ..... F04C 18/025 418/55.5

FOREIGN PATENT DOCUMENTS

CN 101324233 A 12/2008
CN 202991488 U 6/2013
(Continued)

OTHER PUBLICATIONS

EP0012615 A1—Terauchi et al.—Improvements in Scroll Type Fluid Compressor Units—Jun. 25, 1980—the English Machine Translation. (Year: 1980).*
(Continued)

*Primary Examiner* — Theresa Trieu
(74) *Attorney, Agent, or Firm* — Cheng-Ju Chiang

(57) ABSTRACT

An axially flexible compressor includes a stationary scroll, a movable scroll and a gas-discharge cover. The stationary scroll mates with the movable scroll. The stationary scroll includes a first spiral wall. The stationary scroll mates with the gas-discharge cover. The stationary scroll is located at least partially in the gas-discharge cover. The compressor includes a sealing member and an elastic member. The sealing member is located between a circumferential side wall of the stationary scroll and an inner wall of the gas-discharge cover. The stationary scroll defines a gas-discharge hole. An outer wall is located at a position away from the first spiral wall and away from the gas-discharge hole. The elastic member is located between the gas-discharge cover and a side of the stationary scroll away from the movable scroll. The elastic member is in contact with the stationary scroll and the gas-discharge cover.

15 Claims, 14 Drawing Sheets

(52) U.S. Cl.
CPC ..... *F04C 27/005* (2013.01); *F04C 27/007* (2013.01); *F04C 23/008* (2013.01)

(58) Field of Classification Search
CPC ..... F04C 27/007; F04C 29/02; F04C 29/026; F04C 29/12; F04C 2240/603; F04C 2240/801; F04C 2240/802
See application file for complete search history.

(56) References Cited

FOREIGN PATENT DOCUMENTS

| | | | | | |
|---|---|---|---|---|---|
| CN | 206290437 | U | * | 6/2017 | ..... F04C 18/0215 |
| CN | 107893761 | A | | 4/2018 | |
| CN | 209908757 | U | | 1/2020 | |
| CN | 112746957 | A | | 5/2021 | |
| EP | 0404512 | A2 | | 12/1990 | |
| JP | H10-77977 | A | | 3/1998 | |
| JP | 11050981 | A | * | 2/1999 | ..... F04C 18/0215 |
| JP | 2010065586 | A | * | 3/2010 | ..... F04C 18/02 |

OTHER PUBLICATIONS

JP11050981A—Hirooka—Closed Type Scroll Compressor—Feb. 23, 1999—the English Machine Translation. (Year: 1999).*
CN206290437U—Liang et al.—Totally closed compressor that springiness contaction is sealed—Jun. 30, 2017—the English Machine Translation. (Year: 2017).*
CN209908757U—Yang et al.—Static scroll plate and automobile scroll compressor—Jan. 7, 2020—the English Machine Translation. (Year: 2020).*
JP-2010065586-A—Fujimura et al.—Displacement Compressor—Mar. 25, 2010—the English Machine Translation. (Year: 2010).*
CN112746957A—N/A—Scroll compressor shell assembly and scroll compressor—May 4, 2021—the English Machine Translation. (Year: 2021).*

* cited by examiner

AXIALLY FLEXIBLE COMPRESSOR

CROSS-REFERENCE TO RELATED APPLICATION

This patent application claims priority of a Chinese Patent Application No. 202211331124.9, filed on Oct. 28, 2022 and titled "AXIALLY FLEXIBLE COMPRESSOR", the entire content of which is incorporated herein by reference.

TECHNICAL FIELD

The present disclosure relates to the field of compressor technology, and in particular to an axially flexible compressor.

BACKGROUND

A compressor generally includes a movable scroll, a stationary scroll, a gas-discharge cover and a bearing seat. The movable scroll and the stationary scroll mesh with each other to form a compression chamber in order to compress an incoming refrigerant gas. A high-pressure chamber is formed between the stationary scroll and the gas-discharge cover to temporarily store the compressed high-pressure gas. There are multiple compression chambers with different pressure chambers inside the compression chamber. There will inevitably be leakage between adjacent compression chambers with different pressures, which results in reduced volumetric efficiency and increased power. In order to reduce leakage, the dimensional accuracy and shape accuracy of scroll processing are usually very high. But in actual production, there will be times when liquid refrigerant enters the compressor. Due to the incompressibility of the liquid, the scroll plate is subject to a very large load and can easily damage the scroll parts. In this case, the compressor needs to have axial flexibility to separate the movable scroll and the stationary scroll to release the pressure of the liquid refrigerant while keeping the high-pressure chamber from leaking high-pressure gas into the low-pressure chamber.

SUMMARY

An object of the present disclosure is to provide an axially flexible compressor that allows the stationary scroll to move in its axial direction while ensuring the sealing performance of the high-pressure chamber.

In order to achieve the above object, the present disclosure adopts the following technical solution: an axially flexible compressor, including: a stationary scroll including a first spiral wall; a movable scroll mating with the stationary scroll; and a gas-discharge cover, the stationary scroll mating with the gas-discharge cover, the stationary scroll being at least partially located in the gas-discharge cover; wherein the compressor includes a sealing member and an elastic member; the sealing member is located between an outer side wall of the stationary scroll and an inner wall of the gas-discharge cover; the stationary scroll defines a gas-discharge hole; the outer side wall is located at a position of the first spiral wall away from the gas-discharge hole; the elastic member is located between the gas-discharge cover and a side of the stationary scroll away from the movable scroll; the elastic member abuts against and mates with the stationary scroll and the gas-discharge cover.

In order to achieve the above object, the present disclosure adopts the following technical solution: an axially flexible compressor, including: a stationary scroll including a first spiral wall; a movable scroll mating with the stationary scroll; and a gas-discharge cover, the stationary scroll mating with the gas-discharge cover, the stationary scroll being at least partially located in the gas-discharge cover; wherein the compressor includes a sealing member and an elastic member; the sealing member is located between the stationary scroll and the gas-discharge cover; the stationary scroll defines a gas-discharge hole; the elastic member is located between the gas-discharge cover and the stationary scroll; the elastic member abuts against and mates with the stationary scroll and the gas-discharge cover; the stationary scroll is configured to be movable along an axial direction thereof, so that the movable scroll and the stationary scroll can be separated in the axial direction.

The sealing member disclosed in the present disclosure is located between a circumferential side wall of the stationary scroll and the inner wall of the gas-discharge cover. The elastic member is located between the gas-discharge cover and the side of the stationary scroll away from the movable scroll. The elastic member abuts against and mates with the stationary scroll and the gas-discharge cover. Through the cooperation of the sealing member and the elastic member, the high-pressure chamber will not leak high-pressure gas into the low-pressure chamber, while it also allows the movable scroll and the stationary scroll to be separated in the axial direction. The stationary scroll is movable with respect to the movable scroll along an axial direction of the axially flexible compressor between a sealed position where the stationary scroll is abutted against the movable scroll, and an unsealed position where the stationary scroll is separated from the movable scroll.

DETAILED DESCRIPTION

Figure 1:
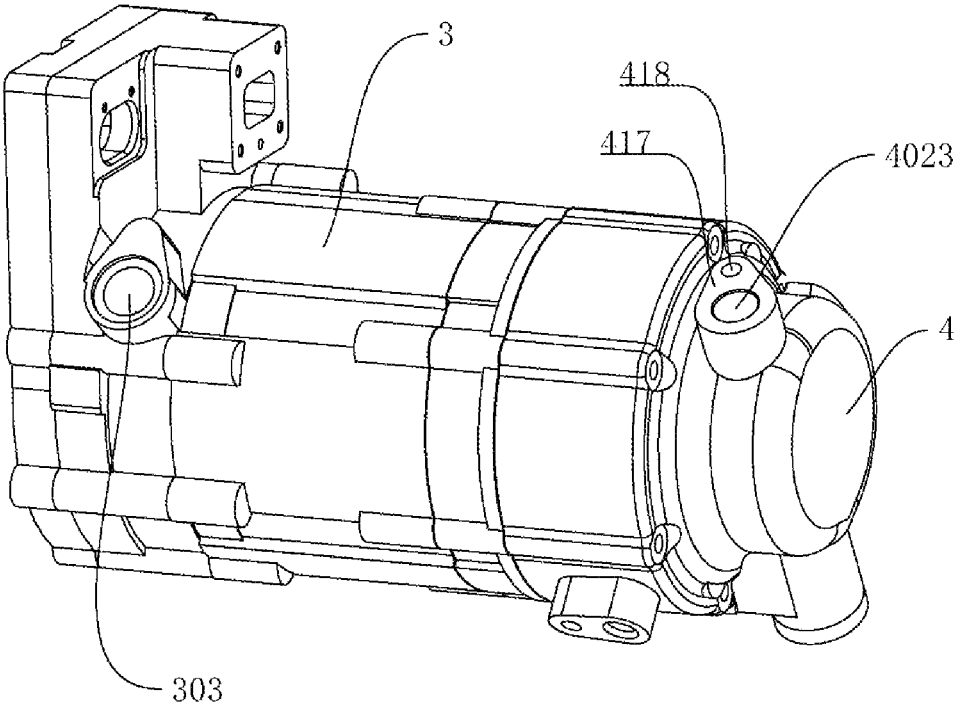
FIG. 1 is a perspective view of a compressor in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 2:
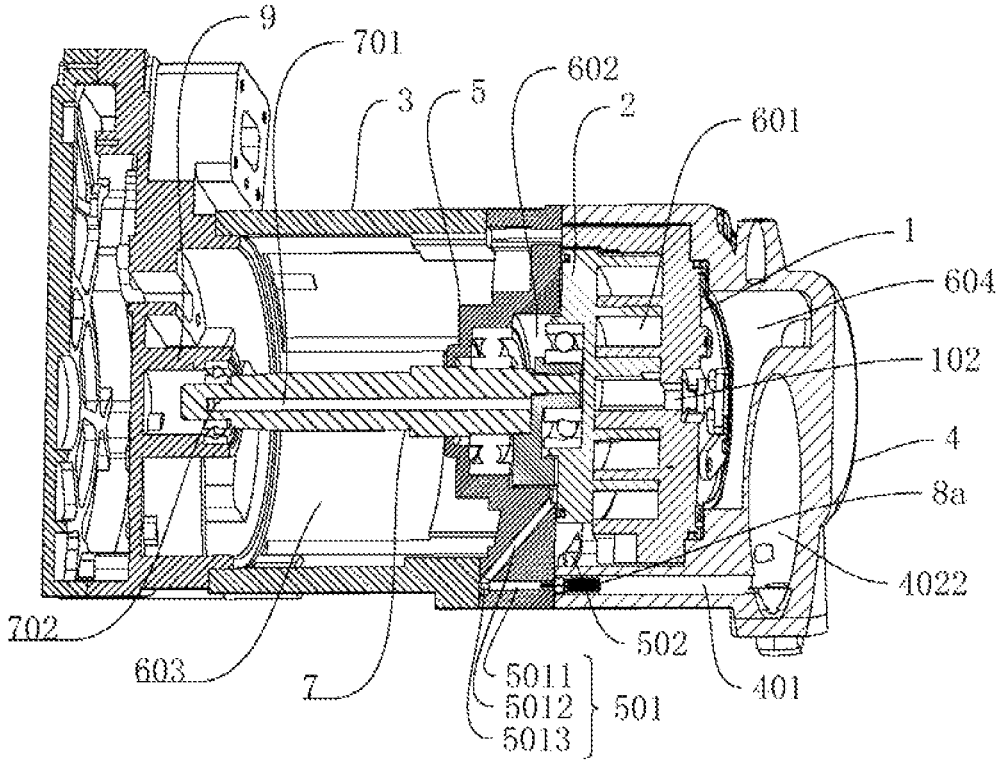
FIG. 2 is a perspective cross-sectional view of the compressor in accordance with the embodiment the present disclosure.

As shown in FIG. 1 and FIG. 2, the present disclosure provides a compressor including a stationary scroll 1, a movable scroll 2, a shell 3, a gas-discharge cover 4 and a main bearing seat 5. The stationary scroll 1 and the movable scroll 2 mate with each other. The compressor defines a compression chamber 601, a back-pressure chamber 602 and a low-pressure chamber 603. The compression chamber 601 is located between the stationary scroll 1 and the movable scroll 2. The back-pressure chamber 602 is located between the main bearing seat 5 and the movable scroll 2. The low-pressure chamber 603 is located between the shell 3 and the main bearing seat 5.

Figure 12:
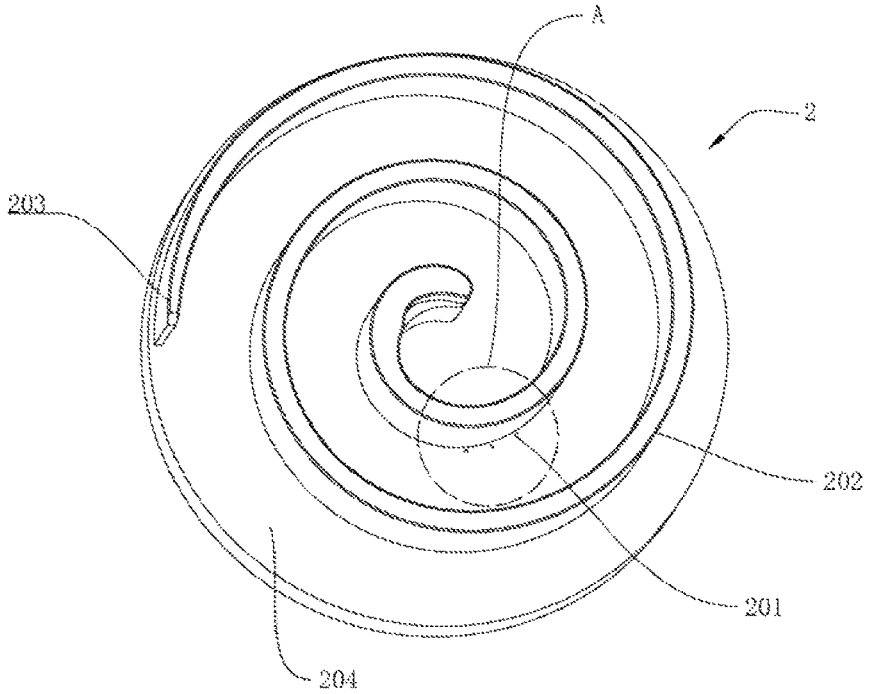
FIG. 12 is a perspective view of a movable scroll in accordance with the embodiment of the present disclosure.
Figure 16:
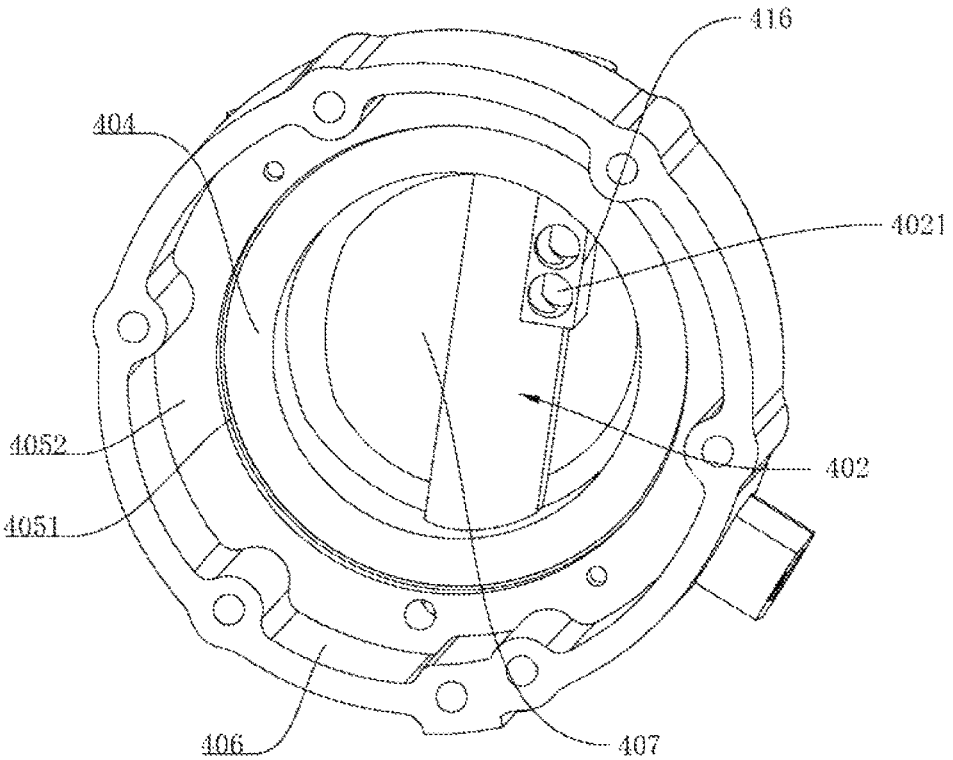
FIG. 16 is a perspective view of a gas-discharge cover in accordance with the embodiment of the present disclosure.
Figure 17:
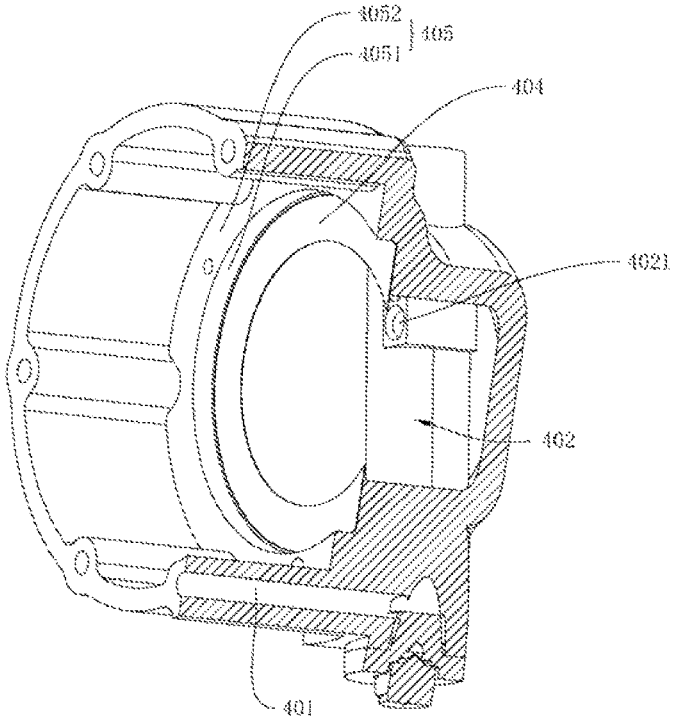
FIG. 17 is a perspective cross-sectional view of the gas-discharge cover at a position of a first oil path in accordance with an embodiment of the present disclosure.

As shown in FIG. 16 and FIG. 17, the gas-discharge cover 4 defines a first oil path 401. As shown in FIG. 2 to FIG. 6, the main bearing seat 5 defines a second oil path 501. The first oil path 401 is in communication with the second oil path 501. The second oil path 501 is in communication with the back-pressure chamber 602. A rotating shaft 7 is partially installed on the main bearing seat 5. The rotating shaft 7 defines a third oil path 701 which is in communication with the back-pressure chamber 602 and the low-pressure chamber 603. As shown in FIG. 12, the movable scroll 2 defines a through hole 201 which communicates with the compression chamber 601 and the back-pressure chamber 602.

The shell 3 is further provided with a stator 301 and a rotor 302 that cooperates with the stator 301. In order to simplify the drawings and facilitate understanding, the stator 301 and the rotor 302 are hidden in FIG. 2 and FIGS. 7 to 9. The rotor 302 is installed cooperatively with the rotating shaft 7. The stator 301 obtains a power source by being electrically connected to an external power source, so that the rotor 302 drives the rotating shaft 7 to rotate. The rotating shaft 7 drives the movable scroll 2 to rotate eccentrically through an eccentric sleeve, thereby cooperating with the stationary scroll 1 to compress the gas. How to make the rotating shaft 7 drive the movable scroll 2 to rotate is understandable to those of ordinary skill in the art, and will not be described in detail here.

When the compressor in this embodiment is in working condition, external air is sucked in through a suction port 303 of the shell 3, and the lubricating oil inside the shell 3 is driven to flow to the low-pressure chamber 603; then it flows from the low-pressure chamber 603 to the compression chamber 601, and is compressed by the cooperation of the movable scroll 2 and the stationary scroll 1.

As shown in FIGS. 12 to 15, the stationary scroll 1 includes a first end plate 106 and a first spiral wall 101. The movable scroll 2 includes a second end plate 204 and a second spiral wall 202. The through hole 201 extends through the second end plate 204. The through hole 201 is located immediately adjacent to a root of the second spiral wall 202.

Figure 14:
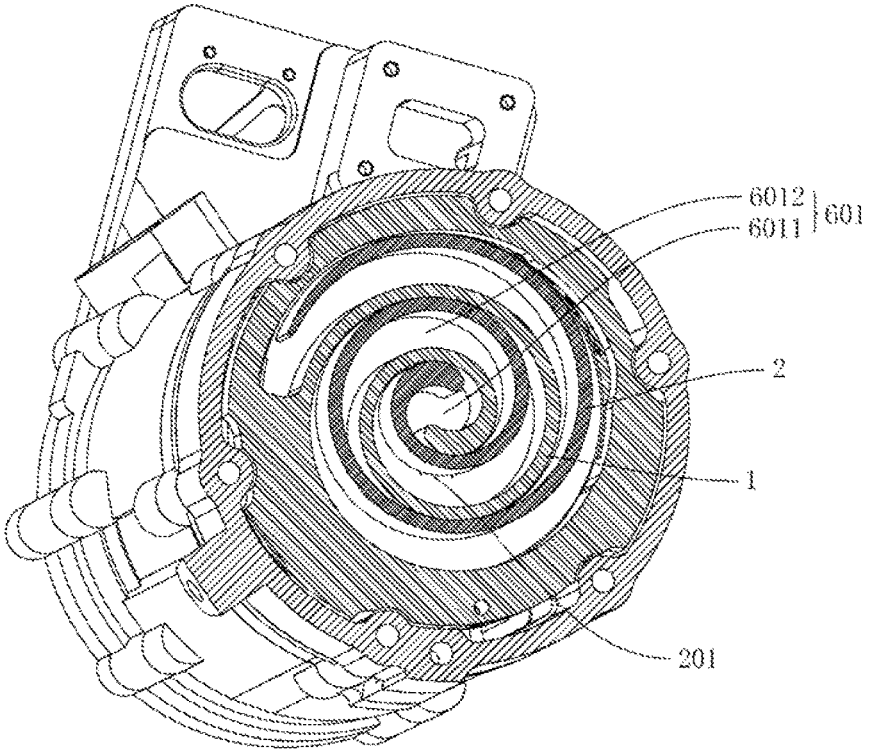
FIG. 14 is a perspective cross-sectional view of the stationary scroll and the movable scroll in a mated state in accordance with an embodiment of the present disclosure.

As shown in FIG. 14, in one embodiment, the compression chamber 601 at least includes a first compression chamber 6011 and a second compression chamber 6012. The first compression chamber 6011 is located at a center of the compression chamber 601. The second compression chamber 6012 is immediately outside the first compression chamber 6011. The third compression chamber 6013 is located outside the second compression chamber 6012 in its radial direction. The through hole 201 communicates with the second compression chamber 6012.

Figure 15:
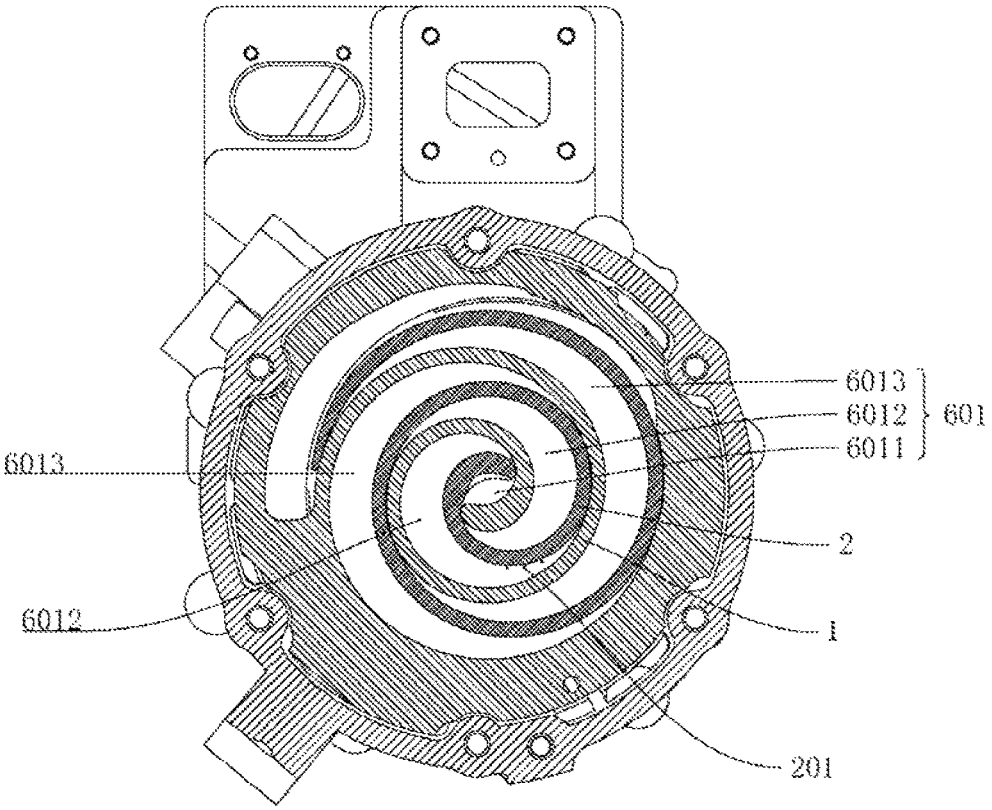
FIG. 15 is a cross-sectional view of the stationary scroll and the movable scroll in another mated state in accordance with an embodiment of the present disclosure.

As shown in FIG. 15, in another embodiment, the second spiral wall 202 has a head end 203 away from the center of the compression chamber 601. When the head end 203 abuts against the first spiral wall 101, the compression chamber 601 includes the third compression chamber 6013. The third compression chamber 6013 is located outside the second compression chamber 6012.

In addition, as shown in FIGS. 2 to 9 and FIGS. 16 to 18, the gas-discharge cover 4 is connected to the stationary scroll 1. The compressor has a high-pressure chamber 604. The high-pressure chamber 604 is located between the gas-discharge cover 4 and the stationary scroll 1. The first end plate 106 defines a gas-discharge hole 102 which communicates with the first compression chamber 6011 and the high-pressure chamber 604. The gas-discharge cover 4 defines a cavity 402 which communicates with the high-pressure chamber 604. An inlet of the first oil path 401 is in communication with the cavity 402.

Figure 7:
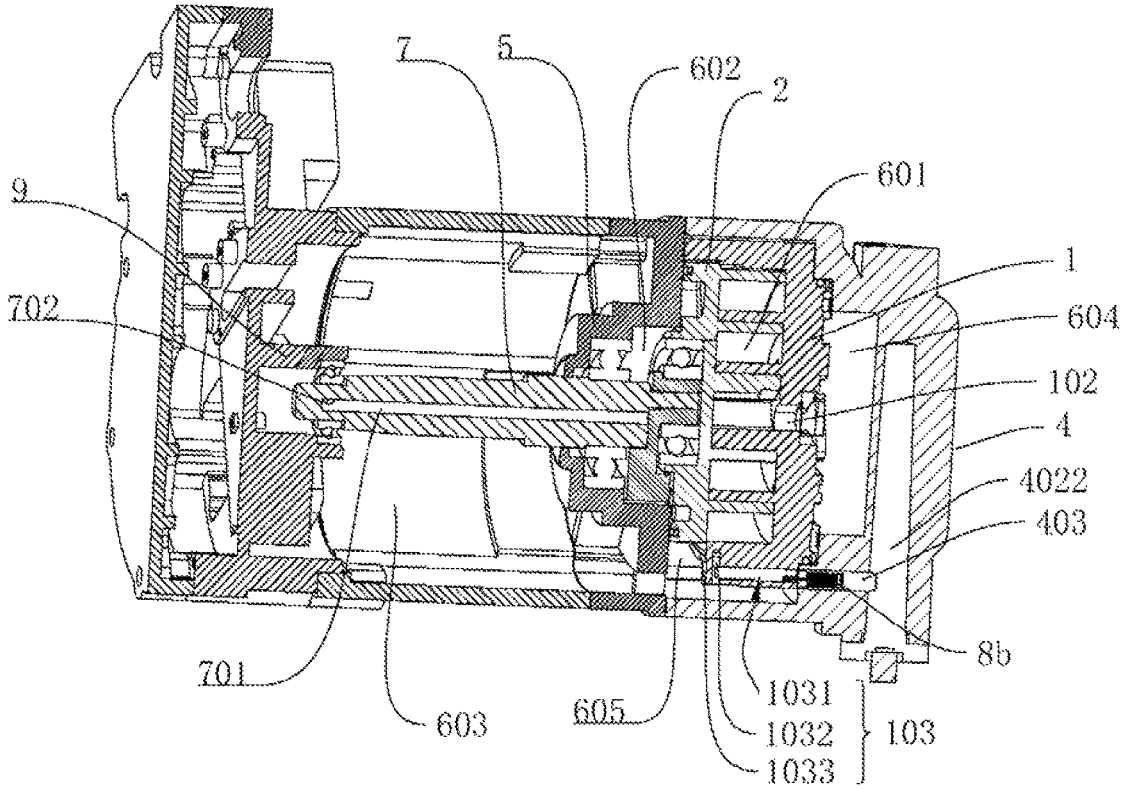
FIG. 7 is a perspective cross-sectional view of the compressor in accordance with the embodiment of the present disclosure at a position of an oil return passage.

The gas compressed by the first spiral wall 101 and the second spiral wall 202 in the compression chamber 601 flows into the high-pressure chamber 604 from the gas-discharge hole 102 located in the middle of the stationary scroll 1. A hole 4021 is provided on a side wall of the cavity 402, as shown in FIGS. 1 and 7, so that the high-pressure chamber 604 and the cavity 402 are in communication with each other. The gas will flow into the cavity 402 for oil and gas separation. The separated gas is discharged from a gas-discharge pipe 4023 located on a top of the cavity 402, while the lubricating oil is filtered and temporarily accumulated at a bottom of the cavity 402.

As shown in FIG. 2 to 6, at this time, due to the communication between the first oil path 401 and the cavity 402, and the communication between the first oil path 401 and the second oil path 501, the lubricating oil can be directed back. The order in which the lubricating oil flows is: from the cavity 402 to the first oil path 401, from the first oil path 401 to the second oil path 501, and from the second oil path 501 to the back-pressure chamber 602. At this time, part of the lubricating oil in the back-pressure chamber 602 flows to the compression chamber 601 through the through hole 201; and another part of the lubricating oil flows to the low-pressure chamber 603 through the third oil path 701 which is in communication with the back-pressure chamber 602.

During this process, the movable scroll 2 continues to rotate eccentrically and cooperates with the stationary scroll 1 to compress the gas. The gas flows from the low-pressure chamber 603 to the head end 203 of the second spiral wall 202 and enters through a gap between the head end 203 and the first spiral wall 101. Then, the gas continues to be compressed and the air pressure of the gas continues to increase. It is highest when the gas is compressed to a middle position of the compression chamber 601, which is also a middle position of the stationary scroll 1 and the movable scroll 2. Therefore, the compression chamber 601 is a high-pressure area. The gas in the compression chamber 601 flows directly into the high-pressure chamber 604, so the air pressure in the high-pressure chamber 604 is also high, and the air pressure in the cavity 402 is also high. The low-pressure chamber 603 inhales gas from the outside without undergoing compression processing, so the low-pressure chamber 603 is a low-pressure area. In addition, due to the through hole 201 in the back-pressure chamber 602, part of the air pressure in the high-pressure area can be introduced into the back-pressure chamber 602. Therefore, the air pressure there is higher than the air pressure of the low-pressure chamber 603. It is worth noting that the high-pressure area, the low-pressure area, the high pressure and the low pressure mentioned in the context are only relative to the pressure in the back-pressure chamber 602, the low-pressure chamber 603, the compression chamber 601 and the high-pressure chamber 604, for the convenience of description and understand.

As shown in FIGS. 2 to 9, a specific range of each cavity is further described below. The specific range and location of the compression chamber 601 are relatively clear, that is, between the movable scroll 2 and the stationary scroll 1 after they are meshed. Moreover, the compressed gas enters from the gap between the head end 203 and the first spiral wall 101. After compression, the compressed air is discharged from the gas-discharge hole 102 opened in the middle of the stationary scroll 1 into the high-pressure chamber 604. The high-pressure chamber 604 is located between the gas-discharge cover 4 and the stationary scroll 1. The stationary scroll 1 is located in the gas-discharge cover 4. The gas-discharge cover 4 is connected to the shell 3 through bolts. At the same time, the stationary scroll 1 is pressed and engaged with the movable scroll 2. A sealing gasket, which may be an O-ring, etc., is provided at a mating position between the stationary scroll 1 and the gas-discharge cover 4 so as to separate the high-pressure chamber 604 from the back-pressure chamber 602 and the low-pressure chamber 603. The gas in the high-pressure chamber 604 can only enter the cavity 402.

The back-pressure chamber 602 is located between the main bearing seat 5 and the movable scroll 2. A sealing gasket, which may be an O-ring, etc., is also provided at an edge position where an end surface of the movable scroll 2 abuts against the main bearing seat 5. A shaft seal is provided between the main bearing seat 5 and the rotating shaft 7. The communication between the back-pressure chamber 602 and other chambers is realized through the through hole 201, the second oil path 501 and the third oil path 701. As a result, this allows the gas and lubricating oil to flow only along a specific path, and there will be no mixing of the inhaled gas and the compressed gas. The low-pressure chamber 603 is for temporarily storing the inhaled gas. The air pressure here is low, and the inhaled gas can flow to the compression chamber 601 from an air guide hole 502 opened at an edge of the main bearing seat 5.

As shown in FIGS. 14 and 15, when gas passes through the gap between the first spiral wall 101 and the second spiral wall 202, the eccentrically rotating movable scroll 2 causes the second spiral wall 202 to continuously cooperate with the first spiral wall 101 to compress the incoming gas. Therefore, the volumes of at least the first compression chamber 6011 and the second compression chamber 6012 formed between the first spiral wall 101 and the second spiral wall 202 will continue to change, and the pressure therein will also continue to change. The specific change process is as follows: when the gas enters the compression chamber 601 from the gap between the head end 203 and the side wall of the first spiral wall 101, the head end 203 will gradually move closer to the side wall of the first spiral wall 101. By pushing the gas toward the middle position of the compression chamber 601, the pressure of the gas will also change from low pressure to high pressure. When the gas reaches the second compression chamber 6012, the pressure of the gas is greater than the pressure when it was first sucked into the low-pressure chamber 603. When the gas is pushed to the middle position of the compression chamber 601, the gas forms a high pressure, and this position is also the position with the highest pressure. When the gas is pushed from the second compression chamber 6012 to the first compression chamber 6011 until the gas in the second compression chamber 6012 enters the first compression chamber 6011, the air pressure in the second compression chamber 6012 will drop. At this time, the pressure in the second compression chamber 6012 is less than the back-pressure chamber 602. When gas is compressed in the second compression chamber 6012, the pressure in the second compression chamber 6012 is greater than the back-pressure chamber 602. Both of the above will cause a difference in air pressure in the second compression chamber 6012 and the back-pressure chamber 602.

Therefore, by providing the through hole 201 in the second compression chamber 6012, when the air pressure in the back-pressure chamber 602 is lower than the second compression chamber 6012, the through hole 201 can introduce part of the pressure in the second compression chamber 6012 into the back-pressure chamber 602, so that the movable scroll 2 is closer to the stationary scroll 1. This avoids excessive separation between the movable scroll 2 and the stationary scroll 1, causing leakage of compressed gas and reducing compression efficiency. Because in actual operation of the compressor, the stationary scroll 1 and the movable scroll 2 are only engaged in a meshing relationship, and they have no other connection relationship. It may therefore happen that the two move away from each other, so that the gas can no longer be compressed. The pressure introduced from the second compression chamber 6012 into the back-pressure chamber 602 can lower the movable scroll 2 toward the stationary scroll 1, thereby preventing the stationary scroll 1 and the movable scroll 2 from moving away from each other, adding a layer of insurance.

On the other hand, when the air pressure in the back-pressure chamber 602 is higher than the pressure in the second compression chamber 6012, by providing the through hole 201, it allows the lubricating oil in the back-pressure chamber 602 to flow to the second compression chamber 6012, thereby lubricating the meshing contact portion of the stationary scroll 1 and the movable scroll 2, and reducing friction. At the same time, when the air pressure in the back-pressure chamber 602 is lower than the pressure in the second compression chamber 6012, the lubricating oil in the second compression chamber 6012 can also flow back into the back-pressure chamber 602 through the through hole 201. The specific process is as follows: when the pressure in the second compression chamber 6012 is less than the back-pressure chamber 602, the air pressure will push the lubricating oil to flow into the second compression chamber 6012. When the pressure in the second compression chamber 6012 decreases and is less than the back-pressure chamber 602, the air pressure will push the lubricating oil in the second compression chamber 6012 back into the back-pressure chamber 602. The reason for the pressure change is as mentioned above. The lubricating oil can flow back and forth in the second compression chamber 6012 and the back-pressure chamber 602 under the push of air pressure, which increases its fluidity and improves the lubrication effect.

Due to different models of the compressor and different user needs, the number of spiral turns of the first spiral wall 101 and the second spiral wall 202 in the compressor will be different. When the number of spiral turns between the two is greater, the third compression chamber 6013 or even more compression chambers will be formed between the two side walls. Moreover, these compression chambers are arranged along the radial direction of the movable scroll 2 or the stationary scroll 1. At this time, the position of the through hole 201 is still set in the second compression chamber 6012. The reason is that the air pressure in the first compression chamber 6011 located in the middle of the compression chamber 601 is relatively high, which will prevent the lubricating oil from appearing as mentioned above. In the case of back and forth flow, on the other hand, if the through hole 201 is provided in the first compression chamber 6011, when the lubricating oil flows from the back-pressure chamber 602 to the first compression chamber 6011, the lubricating oil may directly flow into the high-pressure chamber 604 from the gas-discharge hole 102, thereby failing to lubricate the contact parts between the stationary scroll 1 and the movable scroll 2.

Besides, if the through hole 201 is disposed adjacent to the head end 203, it is also the outermost compression chamber at this time. On the one hand, this position is inconvenient to communicate with the back-pressure chamber 602, so that the lubricating oil cannot be guided to the inside of the compression chamber 601. It is also impossible to introduce the air pressure in the compression chamber at this position into the back-pressure chamber 602. On the other hand, the compression chamber formed near the head end 20 introduces the gas in the low-pressure chamber 603 (that is, the low-pressure area) into the compression chamber 601 for compression. At this time, the air pressure in the compression chamber is not much different from the air pressure in the low-pressure area. At this time, the lubricating oil can only flow from the back-pressure chamber 602 to the compression chamber 601 and cannot flow back. That is to say, the fluidity of the lubricating oil cannot be improved, and the lubrication effect of the lubricating oil cannot be improved.

Only if the through hole 201 is provided on the movable scroll 2 at a position corresponding to the back-pressure chamber 602; the compression chamber where the through hole 201 is located needs to have a pressure greater than the back-pressure chamber 602 after compressing the gas; and the through hole 201 cannot be located in the first compression chamber 6011 (that is, at the highest pressure position); only in this way can the lubricating oil flow back and forth between the compression chamber 601 and the back-pressure chamber 602.

Figure 13:
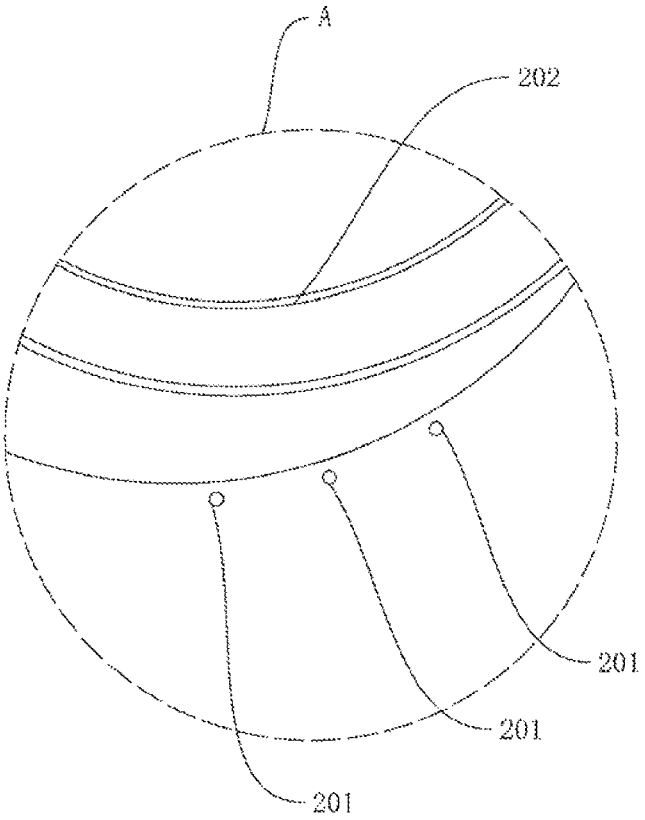
FIG. 13 is an enlarged view of circle A in FIG. 12.

As shown in FIGS. 12 and 13, the through hole 201 is disposed adjacent to the root of the second spiral wall 202 because this position is located on a spiral line of the second spiral wall 202. This position facilitates calculation of the pressure within the compression chamber before production. Since part of the pressure in the compression chamber 601 needs to be introduced into the back-pressure chamber 602 through the through hole 201, how much pressure needs to be introduced through the through holes 201 and how many through holes 201 to open need to be accurately calculated before production. If the through hole 201 is not disposed at the root of the second spiral wall 202, although the same effect can be achieved, it will make the pressure calculation more complicated before production, and it will also increase the difficulty of processing during production, and it will be inconvenient to locate the opening position. However, if the through hole 201 is disposed at the root of the second spiral wall 202, an opening position can be positioned along its spiral line, which is very convenient.

When the gas flows into the compression chamber 601 and is compressed, the lubricating oil in the low-pressure chamber 603 will also be driven into the compression chamber 601. After being compressed and flowing into the cavity 402, the oil and gas are also in a mixed state. Usually, an oil and gas separation device is provided in the cavity 402. This device is also understandable to those skilled in the art, and its structure will not be described in detail here. The separated gas is discharged from the outlet. The lubricating oil will remain in the cavity 402, and flow downwardly under the action of gravity to accumulate at the bottom of the cavity 402. Since the cavity 402 is a high-pressure area, the air pressure will push the lubricating oil to flow to the first oil path 401. Then, it flows from the first oil path 401 to the second oil path 501 and the back-pressure chamber 602. The lubricating oil in the back-pressure chamber 602 then flows to the compression chamber 601 and the third oil path 701, respectively. The third oil path 701 is in communication with the low-pressure chamber 603, so that the lubricating oil can lubricate the stationary scroll 1, the movable scroll 2 and the main bearing seat 5.

Figure 6:
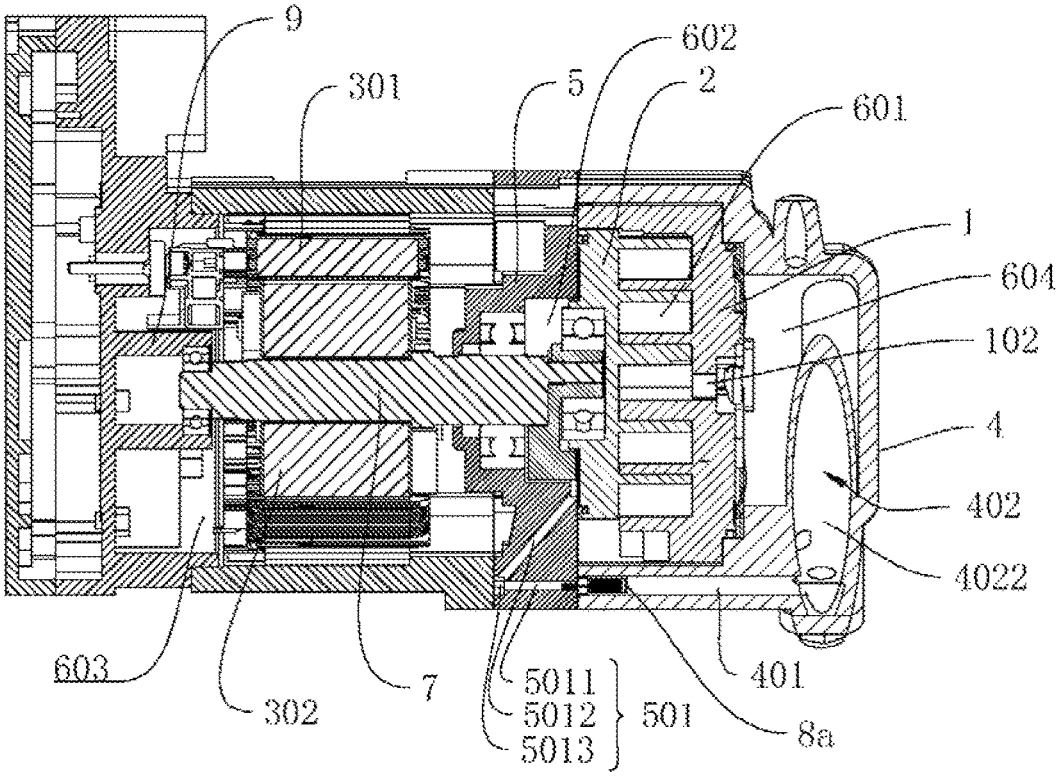

As shown in FIG. 6, a cross-sectional area of the second oil path 501 is smaller than a cross-sectional area of the first oil path 401; and an outlet of the first oil path 401 and an inlet of the second oil path 501 are in communication. Since the cavity 402 is a high-pressure area, when the high-pressure gas pushes the lubricating oil to flow, the lubricating oil will also have pressure, and the lubricating oil will flow rapidly. At this time, the lubricating oil not only has poor lubrication effect, but also after flowing rapidly, there is no seal formed by the lubricating oil in each oil path. The high-pressure gas will return to the back-pressure chamber 602, the low-pressure chamber 603 and the compression chamber 601 along with the first oil path 401, the second oil path 501, the third oil path 701 and the through hole 201, which will cause repeated compression and reduce the efficiency of the compressor.

Therefore, the flow of lubricating oil needs to be throttled. Through the arrangement of the first oil path 401 and the second oil path 501 with different cross-sectional areas, when the lubricating oil flows from the first oil path 401 to the second oil path 501, the flow rate will become smaller, thereby achieving a throttling effect. Due to the throttling effect, the lubricating oil separated in the cavity 402 will not flow out quickly, but will temporarily accumulate in the cavity 402. The accumulated liquid level is higher than the inlet height of the first oil path 401, thereby forming a liquid seal. As a result, the gas can only be discharged from the outlet of the cavity 402, and cannot return to the inside of the compressor from the first oil path 401 and the second oil path 501.

In order to further improve the throttling effect, the compressor includes a first throttling plug 8*a*. The first throttle plug 8*a* is at least partially located in the first oil path 401. The first throttle plug 8*a* is located at the outlet of the first oil path 401. When the lubricating oil enters the first oil path 401, the first throttling plug 8*a* can throttle the flowing lubricating oil in advance, so that the flow rate of the lubricating oil decreases before entering the second oil path 501. Combined with the cooperation of the first oil path 401 and the second oil path 501, the lubricating oil can be effectively throttled.

Figure 3:
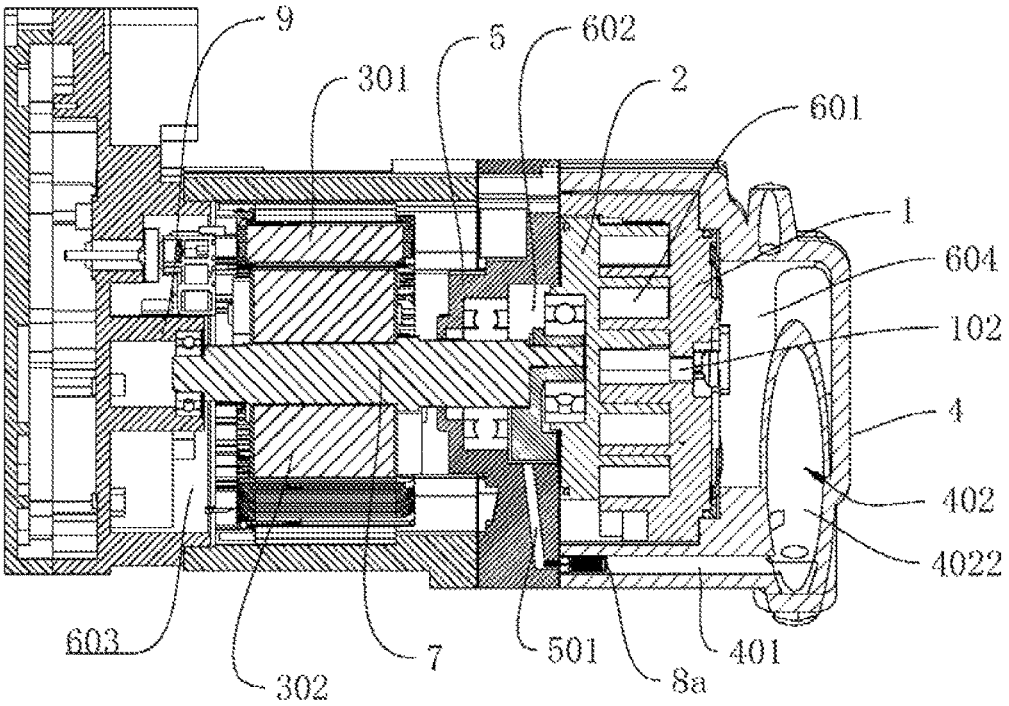
FIG. 3 to FIG. 6 are cross-sectional views of a second oil path in various embodiments of the present disclosure.

In addition, as shown in FIG. 3, in one embodiment, the second oil path 501 is a straight passage, which can be arranged vertically or obliquely in the main bearing seat 5. The inlet of the second oil path 501 is in communication with the outlet of the first oil path 401. The outlet of the second oil path 501 is in communication with the back-pressure chamber 602.

Figure 4:
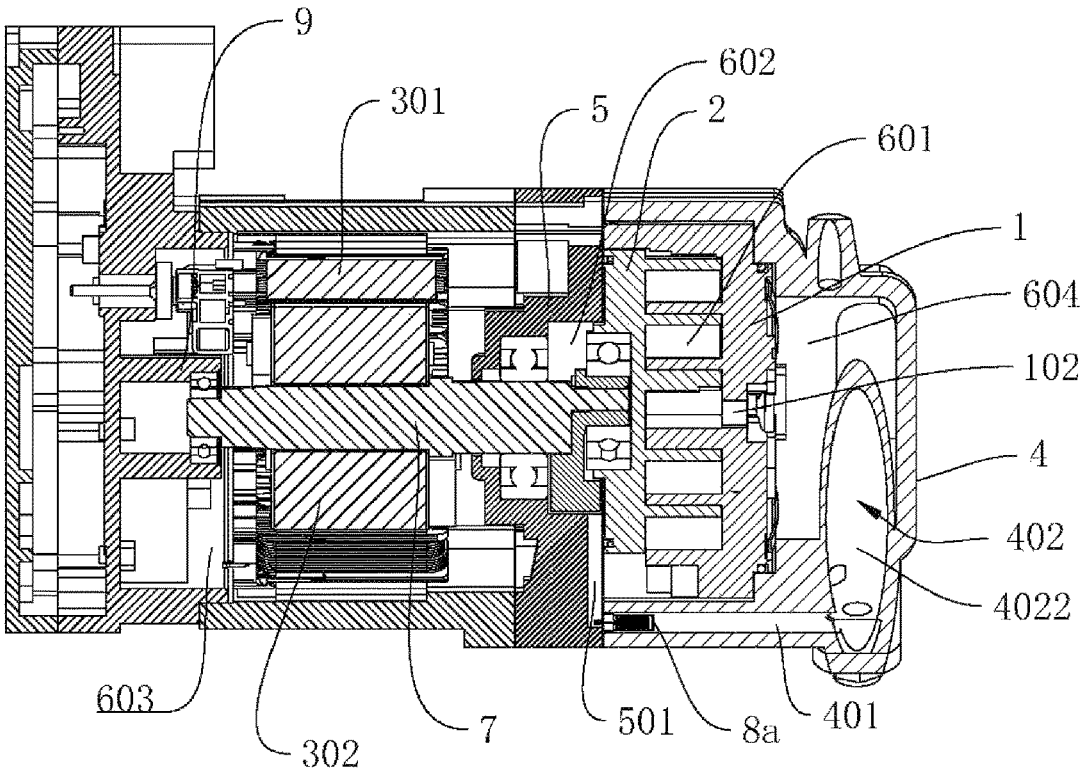

As shown in FIG. 4, in another embodiment, the second oil path 501 is an oil groove opened on an end surface of the main bearing seat 5. Two ends of the oil groove are in communication with the outlet of the first oil path 401 and the back-pressure chamber 602, respectively, so that the lubricating oil flowing in the first oil path 401 is introduced into the back-pressure chamber 602.

Figure 5:
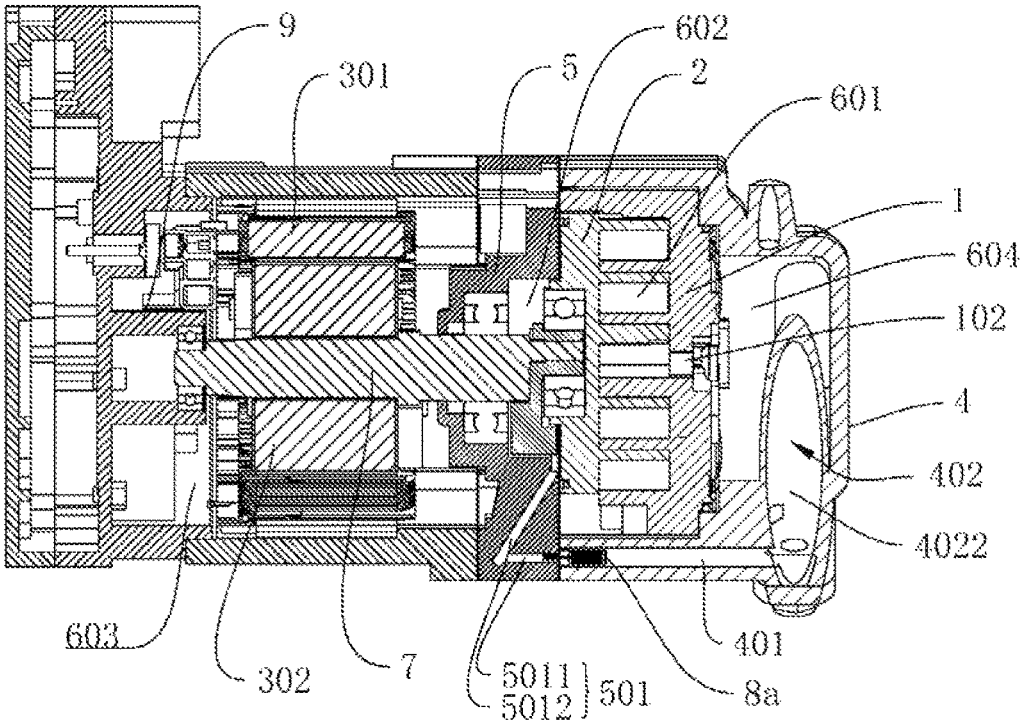

In yet another embodiment, as shown in FIGS. 5 and 6, the second oil path 501 includes an oil inlet section 5011 and an oil outlet section 5012. An inlet of the oil inlet section 5011 is in communication with the outlet of the first oil path 401. An outlet of the oil outlet section 5012 is in communication with the back-pressure chamber 602. An outlet of the oil inlet section 5011 and an inlet of the oil outlet section 5012 are in communication. An included angle is formed by the oil inlet section 5011 and the oil outlet section 5012, or an included angle is formed by straight lines where central axes of the oil inlet section 5011 and the oil outlet section 5012 are located. The included angle is preferably an acute angle, so that the traveling route of the lubricating oil in the second oil path 501 is bent, thereby further slowing down the flow speed of the oil, and achieving the throttling effect.

Figure 19:
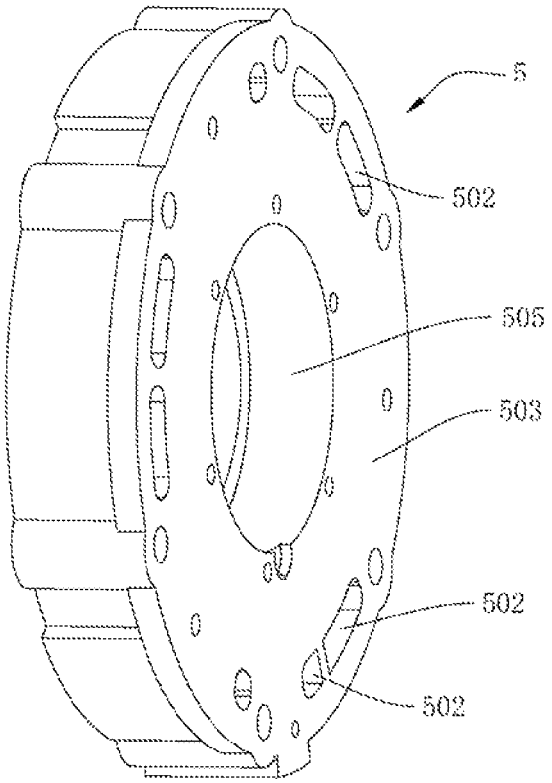
FIG. 19 is a perspective view of a main bearing seat in accordance with an embodiment of the present disclosure.
Figure 20:
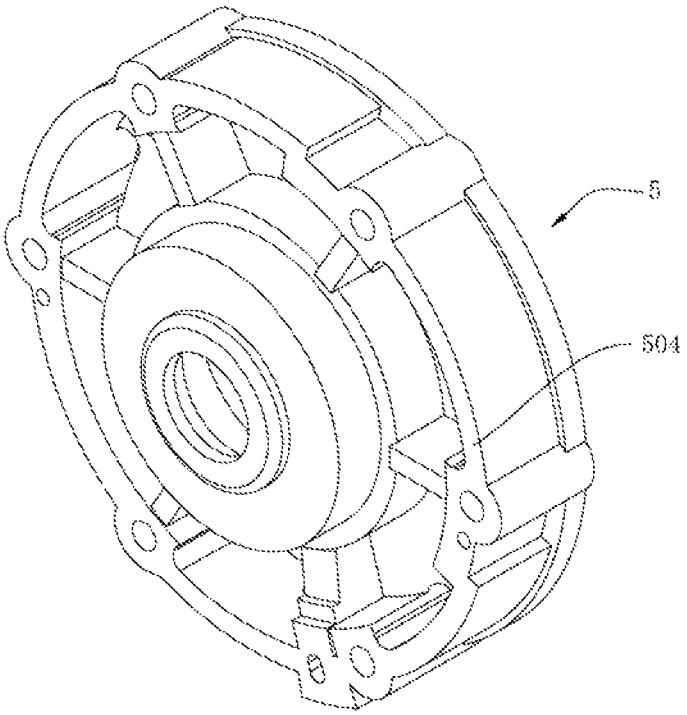
FIG. 20 is a perspective view of the main bearing seat in accordance with the embodiment of the present disclosure from another perspective.
Figure 21:
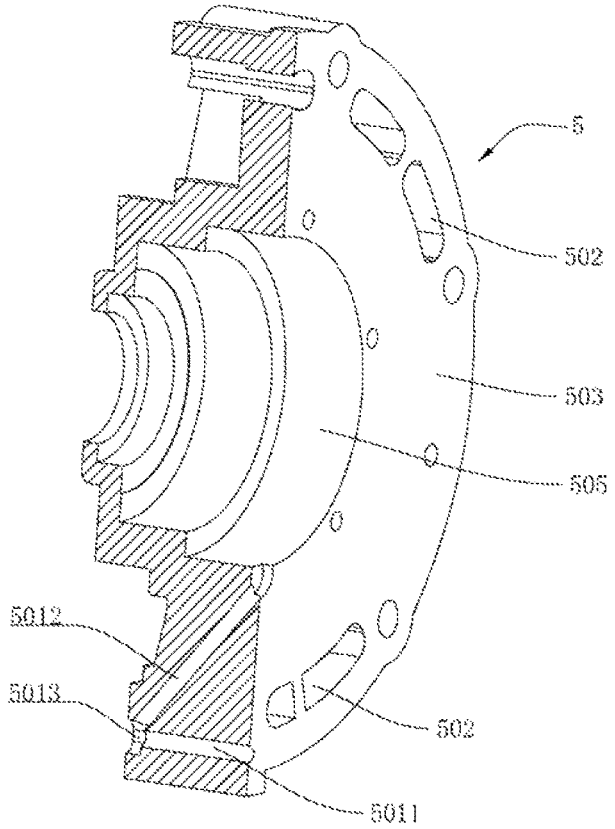
FIG. 21 is a perspective cross-sectional view of the main bearing seat in accordance with the embodiment of the present disclosure.

As shown in FIGS. 19 to 21, the main bearing seat 5 has an oil facing surface 503 and a back oil surface 504. The main bearing seat 5 defines a recessed portion 505. The oil inlet section 5011 extends through the oil facing surface 503 and the back oil surface 504. One end of the oil outlet section 5012 extends through the back oil surface 504, and the other end of the oil outlet section 5012 extends through the oil facing surface 503 or a side wall of the recessed portion 505. At this time, the outlet of the oil inlet section 5011 and the inlet of the oil outlet section 5012 can be directly communicated, or they can be communicated through a communication groove 5013 opened on the main bearing seat 5, so that the lubricating oil flows to the communication groove 5013 through the oil inlet section 5011, and then flows from the communication groove 5013 to the oil outlet section 5012.

When the outlet of the oil inlet section 5011 and the inlet of the oil outlet section 5012 are directly communicated and located in the main bearing seat 5, at this time, at positions of the outlet of the oil inlet section 5011 and the inlet of the oil outlet section 5012, the communication groove 5013 cannot be provided.

In addition, the compressor further includes an auxiliary bearing seat 9 on which the rotating shaft 7 is partially installed. The rotating shaft 7 has a communication hole 702. There is a gap between the auxiliary bearing seat 9 and the rotating shaft 7. The communication hole 702 communicates with the third oil path 701. The communication hole 702 is at least partially in communication with the gap. The gap can be achieved by opening a cutout in a bearing provided on the auxiliary bearing seat 9, so that the lubricating oil can lubricate the bearing.

As shown in FIG. 2, when the lubricating oil flows from the back-pressure chamber 602 to the third oil path 701, by providing the communication hole 702, the oil will first flow into the auxiliary bearing seat 9 and its bearing, and then flow to the low-pressure chamber 603, so that the auxiliary bearing seat 9 can also be fully lubricated.

Figure 8:
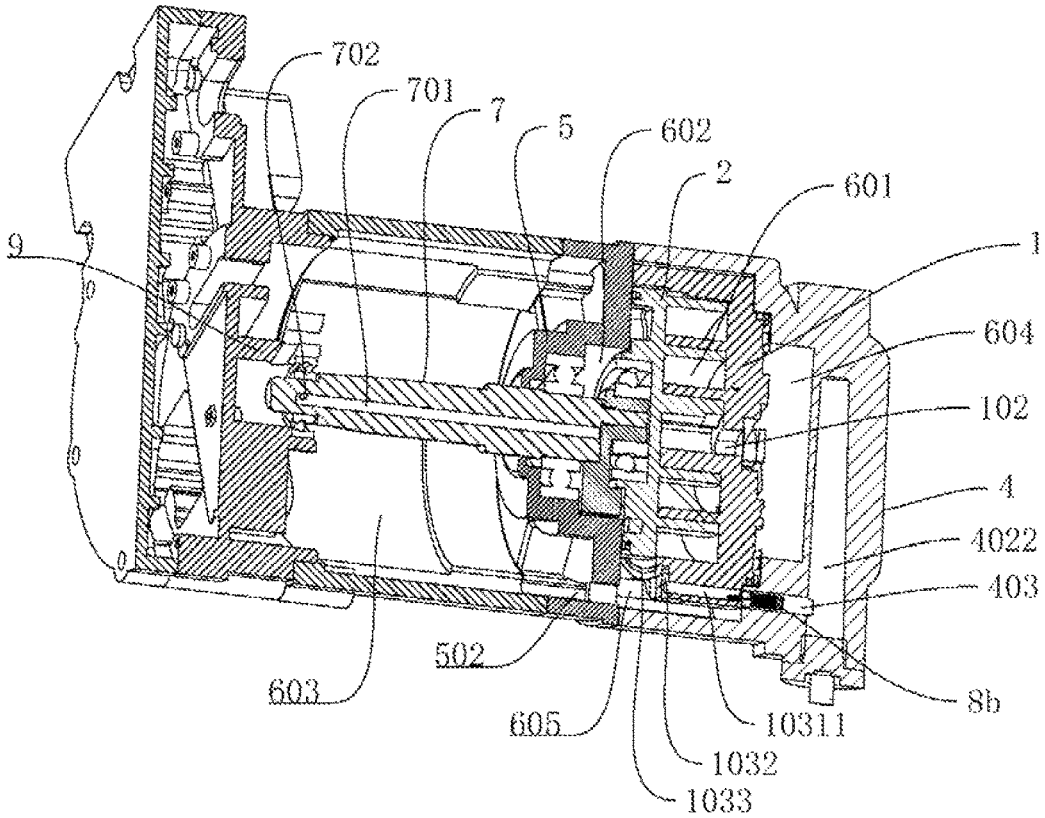
FIG. 8 is a perspective cross-sectional view of the compressor in accordance with the embodiment of the present disclosure at the position of the oil return passage from another perspective.
Figure 9:
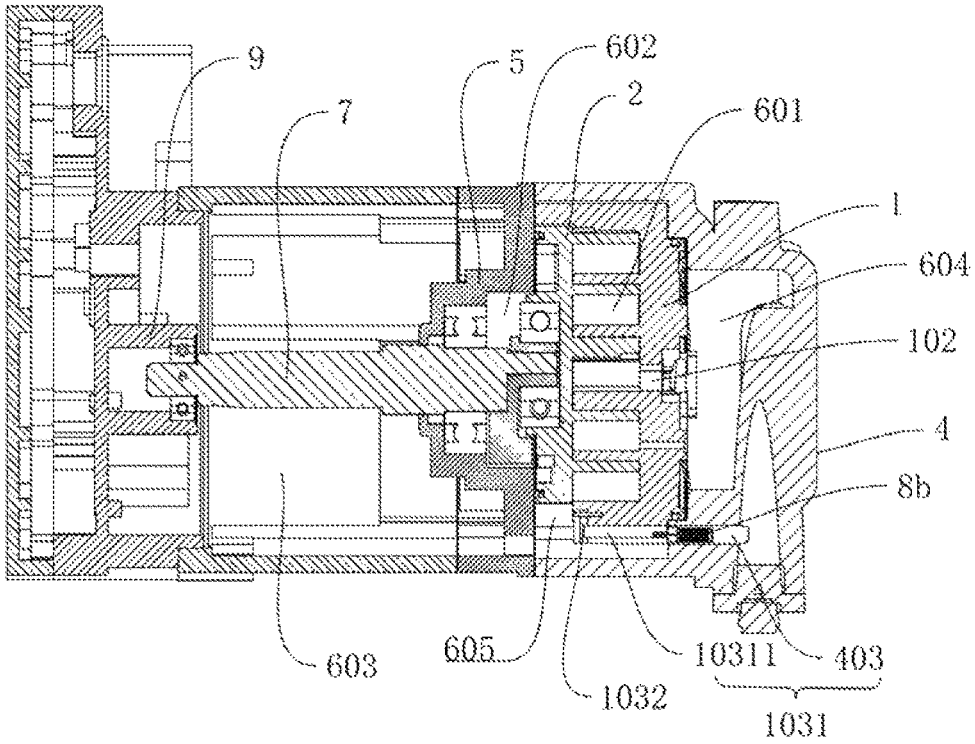
FIG. 9 is a cross-sectional view of the compressor in accordance with the embodiment of the present disclosure at the position of the oil return passage.

As shown in FIGS. 7 to 9, in one embodiment, the compressor has an oil return passage 103. The stationary scroll 1 further includes a first end plate 106 connected to the first spiral wall 101. The movable scroll 2 further includes a second end plate 204. An end of the first spiral wall 101 away from the first end plate 106 is at least partially in contact with the second end plate 204. The oil return passage 103 is located on the stationary scroll 1. An inlet of the oil return passage 103 is in communication with the cavity 402. An outlet of the oil return passage 103 is located at an end of the first spiral wall 101 away from the first end plate 106. The outlet of the oil return passage 103 is capable of communicating with the compression chamber 601.

Wherein, the contact may be that the end of the first spiral wall 101 away from the first end plate 106 is in direct contact with the second end plate 204, thereby forming a fit; or a sealing gasket or the like may also be provided at the end of the first spiral wall 101 away from the first end plate 106. The sealing gasket is arranged along the spiral line, so that the end of the first spiral wall 101 away from the first end plate 106 is in indirect contact with the second end plate 204, which can also form to mate with a compressed gas.

Since the compression of gas mainly depends on the mutual cooperation between the stationary scroll 1 and the movable scroll 2, this part is also the most susceptible to wear. If a traditional method is used, the lubricating oil in the cavity 402 flows back to the low-pressure chamber 603, and then the mixed lubricating oil enters the compression chamber 601 for lubrication through the flow of gas. As a result, the lubricating oil not only travels a longer path, but also has a longer cycle. Lubrication is performed by lubricating oil mixed with low-pressure gas. Due to the low pressure, the amount of lubricating oil entering the compression chamber 601 is also small, and the lubrication effect will be poor. Especially under low temperature conditions, lubricating oil will become more viscous. Low-pressure refrigerant gas cannot fully drive the lubricating oil to flow fully, which will lead to insufficient lubrication of key components. In this embodiment, when the high-pressure gas is mixed with the lubricating oil and separated in the cavity 402, the lubricating oil is directly and quickly introduced into the compression chamber 601 by the high-pressure gas through the oil return passage 103, thereby fully lubricating the contact area between the stationary scroll 1 and the movable scroll 2.

As shown in FIG. 8, during the mating process of the stationary scroll 1 and the movable scroll 2, the eccentric rotation of the second end plate 204 in the movable scroll 2 causes the outlet of the oil return passage 103 to intermittently contact the second end plate 204. When the two are in contact with each other, the lubricating oil in the oil return passage 103 will flow to the second end plate 204. At this time, as the movable scroll 2 continues to rotate and compress the gas, the lubricating oil will also be driven to flow in the compression chamber 601 to fully lubricate the contact area between the stationary scroll 1 and the movable scroll 2. When the outlet of the oil return passage 103 is not in contact with the second end plate 204, the lubricating oil flows out from the outlet of the oil return passage 103 to lubricate the contact area between the stationary scroll 1 and the gas-discharge cover 4.

In one embodiment, the oil return passage 103 is a linear passage, which can be horizontally or obliquely provided on the stationary scroll 1, so as to guide lubricating oil.

In another embodiment, the oil return passage 103 at least includes an oil return section 1031 and a throttling section 1032. An inlet of the oil return section 1031 is in communication with the cavity 402. An outlet of the oil return section 1031 is in communication with the throttling section 1032. An outlet of the throttling section 1032 is located at the end of the first spiral wall 101 away from the first end plate 106.

An interior of the cavity 402 is a high-pressure area, the pressure of the gas is relatively high, and the lubricating oil discharged from the cavity 402 into the oil return passage 103 also has a certain pressure. Same as above, if the flowing lubricating oil is not decompressed, the lubricating oil will flow faster, which will not only lead to poor lubrication effect. Moreover, if the lubricating oil flows at a high speed, the absence of an oil seal formed by the lubricating oil in the oil return passage 103 will cause the compressed gas in the cavity 402 to flow back from the oil return passage 103 to the inside of the compressor. The returned gas will be compressed again, causing repeated compression and reducing the working efficiency of the compressor.

By providing the oil return section 1031 and the throttling section 1032, after the oil return section 1031 introduces the lubricating oil, the throttling section 1032 can throttle and depressurize it. There is a curved flow path between the oil return section 1031 and the throttling section 1032. At this time, the two are not on the same straight line, so that the lubricating oil is decompressed and throttled when it flows through. In one embodiment, the oil return section 1031 is provided on the stationary scroll 1 along the axial direction of the stationary scroll 1. The throttling section 1032 is provided on the stationary scroll 1 along the radial direction of the stationary scroll 1, and the oil return section 1031 and the throttling section 1032 are in communication with each other. At this time, due to the processing method, an inlet of the throttling section 1032 needs to be located on the side wall of the stationary scroll 1 to facilitate processing. However, since the side wall of the stationary scroll 1 is in contact with the inner wall of the gas-discharge cover 4, part of the lubricating oil flowing through the oil return section 1031 can flow out from the inlet of the throttling section 1032 to lubricate the contact area between the stationary scroll 1 and the gas-discharge cover 4. Since the throttling section 1032 is arranged radially along the stationary scroll 1 at this time, an oil hole needs to be opened on the end of the first spiral wall 101 away from the first end plate 106 to communicate with the throttling section 1032, so that the lubricating oil can flow back between the stationary scroll 1 and the movable scroll 2.

An angle of the bent flow path between the oil return section 1031 and the throttling section 1032 can be an obtuse angle or an acute angle. The acute angle has the best throttling and pressure reducing effect, but is more difficult to process. When the above-mentioned bent flow path between the oil return section 1031 and the throttling section 1032 is at a right angle, it is not only easy to process, but also has a better pressure reduction and throttling effect than the obtuse angle.

Figure 10:
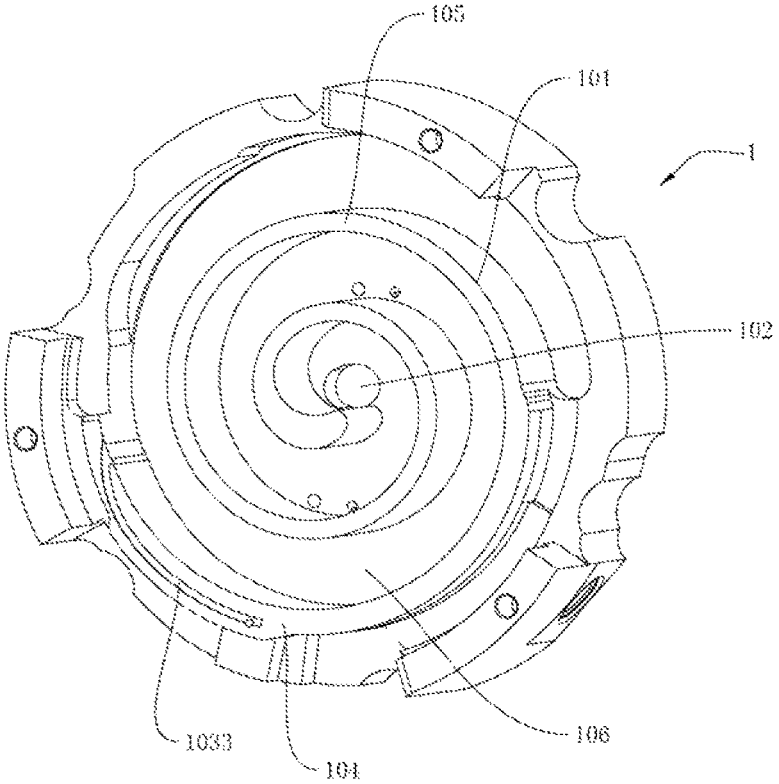
FIG. 10 is a perspective view of a stationary scroll in accordance with an embodiment of the present disclosure.
Figure 11:
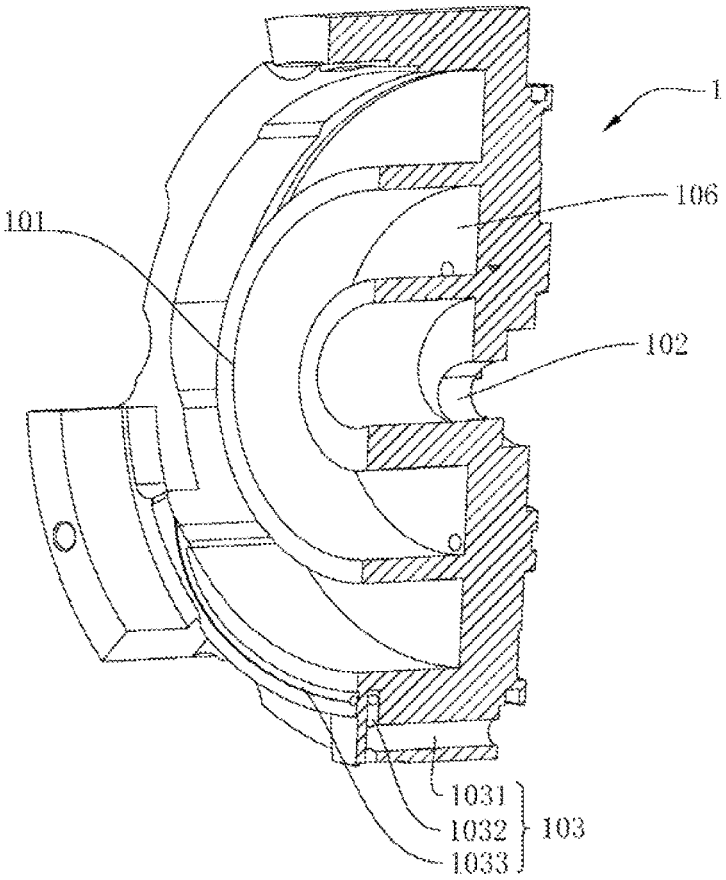
FIG. 11 is a perspective cross-sectional view of the stationary scroll in accordance with the embodiment of the present disclosure.

As shown in FIG. 8 and FIGS. 10 to 11, the compressor defines an oil return groove 1033 located at the end of the first spiral wall 101 away from the first end plate 106. The oil return groove 1033 is in communication with the outlet of the throttling section 1032. When the first spiral wall 101 is in contact with the second end plate 204, the oil return groove 1033 can temporarily accommodate more lubricating oil flowing out from the outlet of the throttling section 1032, thereby increasing the amount of lubricating oil flowing into a space between the stationary scroll 1 and the movable scroll 2.

An end of the oil return groove 1033 away from the outlet of the throttling section 1032 can be in communication with the compression chamber 601 formed between the stationary scroll 1 and the movable scroll 2, when the first spiral wall 101 and the second end plate 204 are in contact. At this time, the lubricating oil can directly enter the compression chamber 601 and lubricate various parts in the chamber as the movable scroll 2 rotates. The lubricating oil will also form an oil seal in the oil return groove 1033, preventing the compressed gas from leaking.

In one embodiment, the first spiral wall 101 has a first end 104 adjacent to the oil return passage 103 and a second end 105 away from the oil return passage 103. The oil return groove 1033 is arc-shaped and extends from the first end 104 to the second end 105.

The oil return groove 1033 extends from the first end 104 to the second end 105, that is, extends from a lower position to a higher position of the stationary scroll 1, thereby sending the lubricating oil to the higher position. The lubricating oil will flow downwardly under its own gravity. Combined with the continuous rotation of the movable scroll 2, the lubricating oil flows, which greatly improves the lubrication effect.

In addition, the cavity 402 has an oil storage area 4022. The inlet of the oil return section 1031 is in communication with the oil storage area 4022. The compressor has a gas-discharge pipe 4023. The gas-discharge pipe 4023 is in communication with the cavity 402. The inlet of the oil return section 1031 is located on a side of the cavity 402 away from the gas-discharge pipe 4023.

The oil return section 1031 includes an oil guide passage 403 and a slow flow passage 10311. The oil guide passage 403 is located in the gas-discharge cover 4. The slow flow passage 10311 is located on the stationary scroll 1. An inlet of the oil guide passage 403 is in communication with the oil storage area 4022. An outlet of the oil guide passage 403 is in communication with the inlet of the slow flow passage 10311. An outlet of the slow flow passage 10311 is in communication with the inlet of the throttling section 1032.

The compressor includes a main bearing seat 5. The compressor defines a low-pressure chamber 603 and an oil guide chamber 605. The oil guide chamber 605 is located between the main bearing seat 5 and the stationary scroll 1. In the radial direction of the stationary scroll 1, the oil guide chamber 605 is located outside the compression chamber 601, and the oil guide chamber 605 is in communication with the low-pressure chamber 603. The main bearing seat 5 defines an air guide hole 502 communicating with the oil guide chamber 605 and the low-pressure chamber 603.

After the lubricating oil is separated by the oil and gas separation device in the cavity 402, the lubricating oil flows downwardly under the action of gravity and is temporarily stored in the oil storage area 4022. Then, the lubricating oil is introduced into the oil return passage 103 through the oil guide passage 403, and then flows out through the outlet of the throttling section 1032. As the first spiral wall 101 and the second end plate 204 come into contact with each other, the inlet of the throttling section 1032 will be exposed intermittently. When the inlet of the throttling section 1032 is exposed, the lubricating oil will flow into the oil guide chamber 605 from the inlet of the throttling section 1032. The air guide hole 502 guides the lubricating oil temporarily stored in the oil guide chamber 605 to the low-pressure chamber 603.

Figure 18:
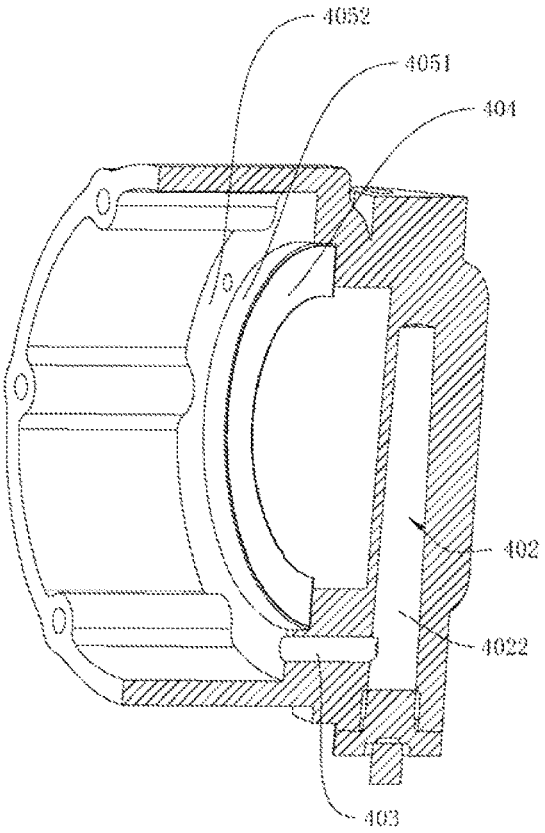
FIG. 18 is a perspective cross-sectional view of the gas-discharge cover at a position of an oil guide passage in accordance with an embodiment of the present disclosure.

As shown in FIGS. 16 to 18, by providing the inlet of the oil return section 1031 on the side away from the gas-discharge pipe 4023 allows the lubricating oil accumulated in the oil storage area 4022 to submerge the inlet of the oil return section 1031, thereby forming an oil seal. This prevents the compressed gas in the cavity 402 from leaking back into the low-pressure chamber 603 from the oil return section 1031 and causing repeated compression.

A cross-sectional area of the slow flow passage 10311 is smaller than a cross-sectional area of the oil guide passage 403. The compressor includes a second throttle plug **8*b* which is at least partially located in the oil guide passage 403. The cross-sectional area of the slow flow passage 10311 is smaller than the cross-sectional area of the oil guide passage 403, which can reduce the amount of lubricating oil flowing therethrough. Combined with the second throttling plug 8*b*, the lubricating oil can be effectively throttled and decompressed, so that the separated lubricating oil can be temporarily accumulated in the cavity 402, and the lubricating oil has a liquid level higher than the inlet of the oil return section 1031**.

In one embodiment, the lubricating oil entering the compression chamber 601 from the throttling section 1032 can flow into the back-pressure chamber 602 from the through hole 201, so as to lubricate the main bearing seat 5 and the contact area between the main bearing seat 5 and the movable scroll 2.

The lubricating oil in the cavity 402 can not only flow into the space between the stationary scroll 1 and the movable scroll 2 from the oil return passage 103, but also flow through the first oil path 401, the second oil path 501 and the third oil path 701, so as to lubricate the stationary scroll 1, the movable scroll 2, the main bearing seat 5 and the auxiliary bearing seat 9. This reasonable distribution of lubricating oil can greatly reduce the wear of various components.

Figure 22:
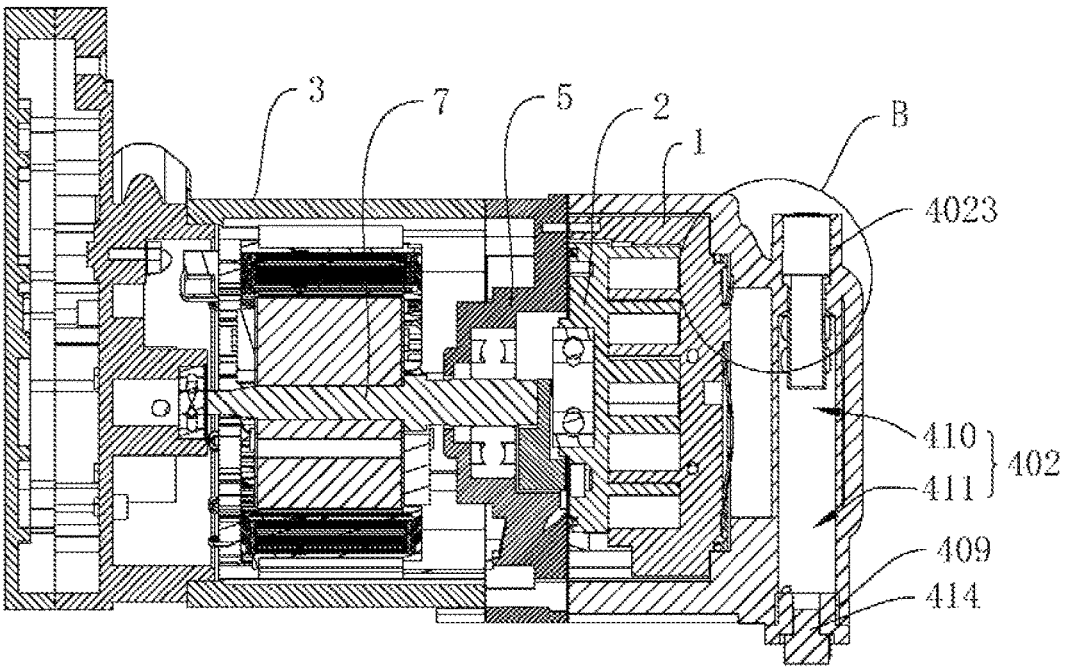
FIG. 22 is a cross-sectional view of a gas-discharge oil separation structure of the compressor in accordance with an embodiment of the present disclosure.

As shown in FIGS. 22 to 27, the compressor further includes an oil distribution pipe 408 which is installed on the gas-discharge cover 4. As shown in FIGS. 1 and 22, the cavity 402 includes a separation section 410 and an oil storage section 411. The oil distribution pipe 408 is located at least partially within the separation section 410. The gas-discharge cover 4 has a gas-discharge pipe 4023 and a blocking hole passage 409. In an axial direction of the oil distribution pipe 408, the gas-discharge pipe 4023 and the blocking hole passage 409 are located on opposite sides of the cavity 402, respectively. The compressor includes a blocking portion 414 which is at least partially located in the blocking hole passage 409. The blocking portion 414 blocks one side of the cavity 402. The oil storage section 411 is closer to the blocking portion 414 than the separation section 410.

When processing the cavity 402, the processing is performed from two sides along an axial direction of the oil distribution pipe 408, and the formed gas-discharge pipe 4023 is used to lead out the high-pressure gas. The blocking hole passage 409 can be used for inspection and maintenance of the interior of the cavity 402. The gas-discharge pipe 4023 and the blocking hole passage 409 are located on different sides, so that the blocking hole passage 409 is close to the first oil path 401 and the oil guide passage 403. Therefore, the blocking hole passage 409 can also be cleaned and dredged in time when impurities block the first oil path 401 and the oil guide passage 403. Then, the oil distribution pipe 408 is installed from the gas-discharge pipe 4023 into the cavity 402, and at least part of the oil distribution pipe 408 is extended into the separation section 410, so that the gas containing lubricating oil in the separation section 410 can be separated through the filtration of the oil distribution pipe 408. The separated lubricating oil can be temporarily accumulated into the oil storage area 4022 from the outer wall of the oil distribution pipe 408 and the inner wall of the cavity 402.

As shown in FIGS. 22 to 23 and FIGS. 26 and 27, the gas-discharge pipe 4023 is in communication with the cavity 402. A hole diameter of the separation section 410 is larger than a hole diameter of the gas-discharge pipe 4023. The gas-discharge pipe 4023 has an annular stopper 412. The oil distribution pipe 408 has a contact portion 413. Along the axial direction of the oil distribution pipe 408, the contact portion 413 abuts against the annular stopper 412.

The separation section 410 has a larger hole diameter than the gas-discharge pipe 4023, so that when the oil distribution pipe 408 partially extends into the separation section 410, there is still a large gap between the inner wall of the separation section 410 and the outer wall of the oil distribution pipe 408, so that no pressure loss occurs when the high-pressure gas passes through the gap. If the hole diameter of the separation section 410 is the same as or smaller than the hole diameter of the gas-discharge pipe 4023, after the oil distribution pipe 408 is installed, the distance between the outer wall of the oil distribution pipe 408 and the inner wall of the separation section 410 will become smaller. When high-pressure gas enters cavity 402 from this gap, a loss of pressure occurs. Processing the cavity 402 from opposite sides can facilitate the processing of the separation section 410 and the gas-discharge pipe 4023. If the opening is only processed from a side of the gas-discharge pipe 4023, it will be difficult to process the hole diameter of the separation section 410 to be larger than the hole diameter of the gas-discharge pipe 4023. Processing from two sides not only facilitates precise control of the hole diameter of the separation section 410 to be larger than the gas-discharge pipe 4023, but the blocking hole passage 409 also provides an additional inspection port for the cavity 402.

The oil distribution pipe 408 is detachably installed in the cavity 402. The contact portion 413 is in contact with the annular stopper 412, and the position limiting is achieved through the contact between the two. The oil distribution pipe 408 partially extends into the separation section 410.

In addition, the compressor defines a hole 4021 communicating with the high-pressure chamber 604 and the cavity 402. In the axial direction of the oil distribution pipe 408, the maximum distance between a portion of the oil distribution pipe 408 located in the separation section 410 and the annular stopper 412 is greater than the maximum distance between the hole 4021 and the annular stopper 412.

The gas compressed by the cooperation of the stationary scroll 1 and the movable scroll 2 will be temporarily stored in the high-pressure chamber 604, and then flows into the cavity 402 through the hole 4021. The maximum distance between the portion of the oil distribution pipe 408 located in the separation section 410 and the annular stopper 412 is greater than the maximum distance between the hole 4021 and the annular stopper 412, so that the end of the oil distribution pipe 408 can be kept away from the hole 4021. In this way, when the gas enters the cavity 402, the gas will first move to the oil storage area 4022 along the axis of the cavity 402, and then move to the end of the oil distribution pipe 408 to separate the oil and gas and then export them. As a result, the gas mixed with the lubricating oil moves toward the oil storage area 4022 first. After the movement, the gas will be exported from the end of the oil distribution pipe 408, and combined with the gravity of the lubricating oil, the oil and gas separation effect will be greatly improved. Moreover, the gas entering from the hole 4021 will also contact the inner wall of the cavity 402 and the outer wall of the oil distribution pipe 408, so some lubricating oil will also adhere to it, which also indirectly improves the oil and gas separation effect. The adhered lubricating oil will slide down the side wall to the oil storage area 4022 for temporary storage.

In one embodiment, the hole 4021 is located on the separation section 410. The hole 4021 can be directly opened on the side wall of the separation section 410.

The hole 4021 is located at a position of the separation section 410 adjacent to the gas-discharge pipe 4023. The closer the hole 4021 is to the gas-discharge pipe 4023, that is, the farther away from the end of the oil distribution pipe 408 located in the separation section 410. In this way, the gas will travel a longer distance after entering the cavity 402. More lubricating oil will adhere to the outer wall of the oil distribution pipe 408 and the inner wall of the separation section 410, which is more conducive to the separation of oil and gas. If the hole 4021 is close to the end of the oil distribution pipe 408 located in the separation section 410, the incoming gas will be immediately discharged from the end of the oil distribution pipe 408. As a result, the effect of the oil distribution pipe 408 in separating lubricating oil and high-pressure gas will become worse.

Figure 26:
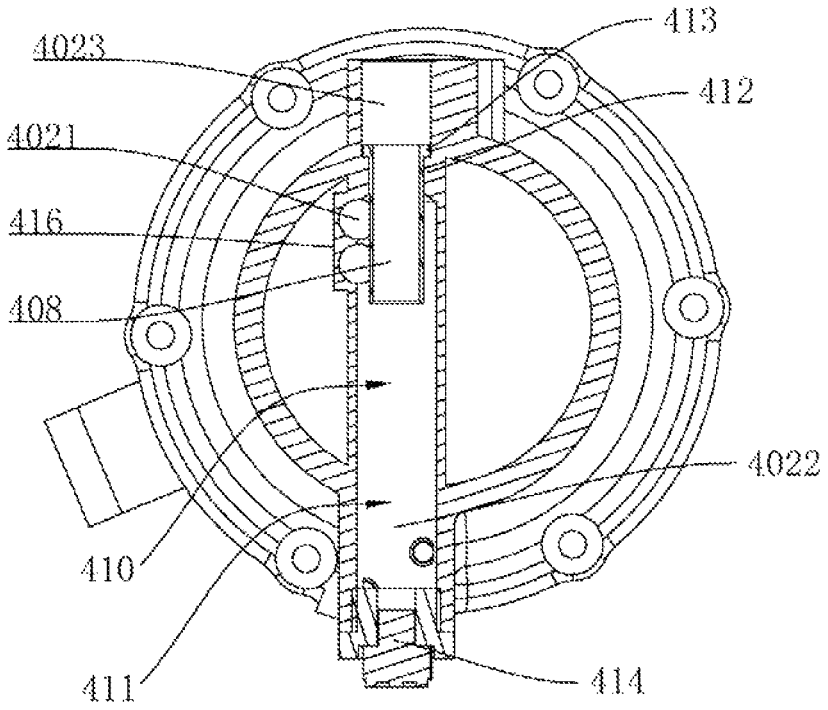
FIG. 26 is a cross-sectional view of a cavity in accordance with an embodiment of the present disclosure.
Figure 27:
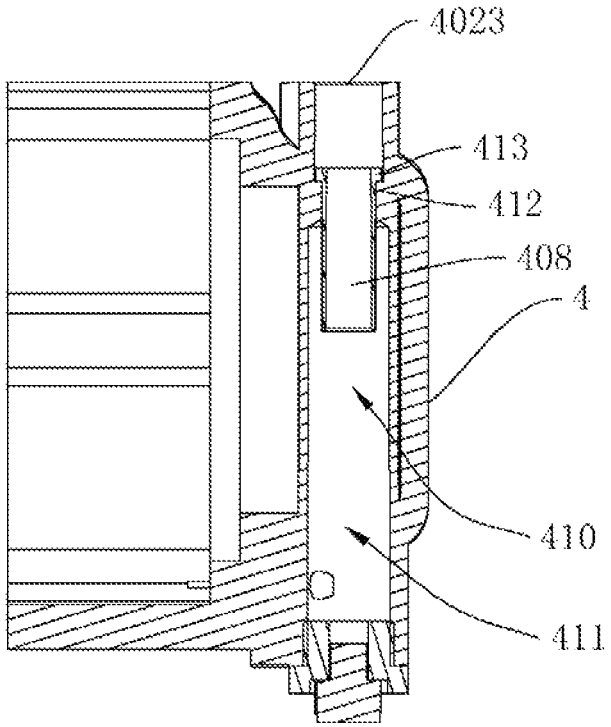
FIG. 27 is a cross-sectional view of the cavity in accordance with the embodiment of the present disclosure from another angle.

In another embodiment, as shown in FIGS. 16 and 26, the gas-discharge cover 4 has an extension portion 416. The extension portion 416 is provided on the separation section 410. The hole 4021 is provided on the extension portion 416. In the axial direction of the hole 4021, the position between the outer wall of the oil distribution pipe 408 and the inner wall of the cavity 402 is opposite to at least part of the hole 4021.

At this time, when gas enters the cavity 402 from the hole 4021, the gas does not directly contact the oil distribution pipe 408, but enters from a space between the outer wall of the oil distribution pipe 408 and the inner wall of the cavity 402. Moreover, the gas forms a spiral inflow between the outer wall of the oil distribution pipe 408 and the inner wall of the cavity 402. In this air intake mode, the lubricating oil will be thrown onto the inner wall of the cavity 402 under the action of centrifugal force, which further improves the oil-gas separation effect.

As shown in FIG. 16, the gas-discharge cover 4 has an inner annular wall 406 and an inner end wall 407. The cavity 402 is located at least partially in inner end wall 407. Two ends of the cavity 402 extend through the gas-discharge cover 4.

The cavity 402 may be partially located on the inner end wall 407 of the gas-discharge cover 4, or may be entirely located in the inner end wall 407. But no matter which method is adopted, the two ends of the cavity 402 shall extend through the gas-discharge cover 4, in order to communicate with the gas-discharge pipe 4023 and the blocking hole passage 409.

In one embodiment, the blocking portion 414 is threadedly engaged with the blocking hole passage 409. The blocking portion 414 blocks the blocking hole passage 409, which not only facilitates installation, but also facilitates inspection and maintenance.

In another embodiment, the blocking portion 414 and the blocking hole passage 409 are welded together.

As shown in FIG. 1, the gas-discharge cover 4 has a mounting portion 417. The mounting portion 417 defines a mounting hole 418. The gas-discharge pipe 4023 is at least partially located in the mounting portion 417. The mounting portion 417 is configured to provide a connection point when the gas-discharge pipe 4023 is connected to an external device, and also to facilitate the alignment of the external device and the gas-discharge pipe 4023.

In addition, in one embodiment, as shown in FIGS. 22 to 25, the compressor further includes a sealing member 10 and an elastic member 11. The sealing member 10 is located between an outer wall of the stationary scroll 1 and an inner wall of the gas-discharge cover 4. The stationary scroll 1 defines a gas-discharge hole 102. The outer wall is located at a position away from the first spiral wall 101 and away from the gas-discharge hole 102. The elastic member 11 is located between the gas-discharge cover 4 and a side of the stationary scroll 1 away from the movable scroll 2. The elastic member 11 is in contact with the stationary scroll 1 and the gas-discharge cover 4.

When the stationary scroll 1 and the movable scroll 2 cooperate with each other to compress the refrigerant gas, liquid refrigerant will also enter the compression chamber 601. However, due to the incompressibility of the liquid, there will be a greater pressure in the compression chamber at this time. By providing the elastic member 11, it can cause the stationary scroll 1 to move in its axial direction, thereby separating the stationary scroll 1 and the movable scroll 2 and releasing the pressure of the liquid refrigerant. When the pressure becomes smaller, the elastic member 11 can press the stationary scroll 1 and move closer to the movable scroll 2 to continue compressing the gas. The stationary scroll 1 is movable with respect to the movable scroll 2 along an axial direction of the axially flexible compressor between a sealed position where the stationary scroll 1 is abutted against the movable scroll 2, and an unsealed position where the stationary scroll 1 is separated from the movable scroll 2.

Figure 23:
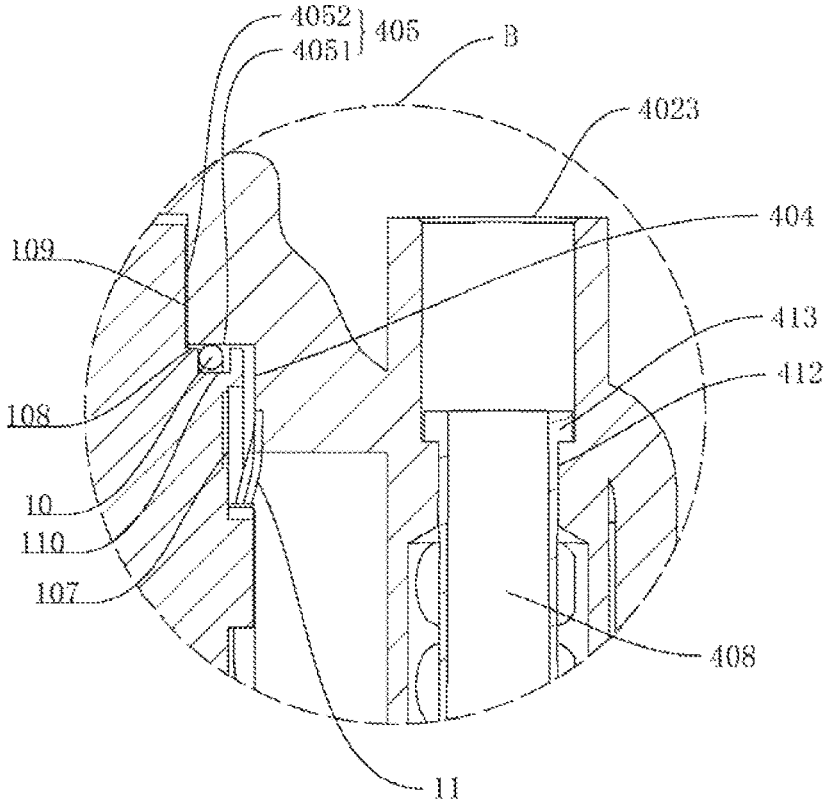
FIG. 23 is an enlarged view of circle B in FIG. 22.

As shown in FIG. 23, the elastic member 11 is directly in contact with the stationary scroll 1 and the gas-discharge cover 4. When the pressure in the compression chamber 601 is too high, the elastic member 11 can react quickly to avoid the stationary scroll 1 in its axial direction. Or, when the excessive pressure in the compression chamber 601 is relieved, the elastic member 11 can quickly react to press the stationary scroll 1 and fit into the movable scroll 2. Since the high-pressure chamber 604 is located between the stationary scroll 1 and the gas-discharge cover 4, in order to ensure the sealing performance of the high-pressure chamber 604, the traditional sealing method is to provide a sealing member 10 between the stationary scroll 1 and the gas-discharge cover 4. However, the problem therein is that when the stationary scroll 1 moves, the sealing performance between the stationary scroll 1 and the gas-discharge cover 4 fails, and good sealing cannot always be maintained. In this embodiment, the sealing member 10, which may be an O-ring, is disposed between the outer wall of the stationary scroll 1 and the inner wall of the gas-discharge cover 4. At this time, since the outer wall of the stationary scroll 1 is at least partially located inside the gas-discharge cover 4, and the inner wall of the gas-discharge cover 4 has a length in the axial direction, the sealing member 10 can always be kept between the outer wall of the stationary scroll 1 and the inner wall of the gas-discharge cover 4. Even if the stationary scroll 1 moves axially, there will be no sealing failure. The sealing performance of the high-pressure chamber 604 can be achieved only through the elastic member 11 and the sealing member 10. At the same time, the stationary scroll 1 has axial flexibility and can move along its axial direction. As a result, the structure is simpler, the installation is more convenient, and the practicability is wider.

Among them, the gas-discharge cover 4 has an inner abutment portion 404. The first end plate 106 define a receiving groove 107. Along the axial direction of the stationary scroll 1, the receiving groove 107 is at least partially opposite to the inner abutment portion 404. The elastic member 11 is at least partially located in the receiving groove 107. The elastic member 11 abuts against and mats with the inner abutment portion 404 and the stationary scroll 1.

On the one hand, the inner abutment portion 404 can provide a contact point for the stationary scroll 1; and on the other hand, it can also form a high-pressure chamber 604 between the stationary scroll 1 and the gas-discharge cover 4. The arrangement of the receiving groove 107 also facilitates the installation of the elastic member 11, and the receiving groove 107 also has a limiting effect on the elastic member 11, so that there will be no positional deviation in the working state, thereby preventing the elastic member 11 from failing to function.

The receiving groove 107 is located at a central position away from the first end plate 106. The gas-discharge cover 4 has an inner annular wall 406 and an inner end wall 407. The inner abutment portion 404 is located on the inner annular wall 406. With this arrangement, when the elastic member 11 in the receiving groove 107 contacts the inner wall of the gas-discharge cover 4, it will be more stable and the force will be more even. If the receiving groove 107 is arranged close to the center of the first end plate 106, if the pressure in the compression chamber 601 is too high, the stationary scroll 1 will press against the gas-discharge cover 4. At this time, the elastic member 11 may deform to one side, resulting in uneven force on the stationary scroll 1. For example, when one end surface of the stationary scroll 1 is in contact with the inner wall of the gas-discharge cover 4, the other end surface of the stationary scroll 1 has not yet contacted the inner wall of the gas-discharge cover 4, thereby aggravating the wear of the stationary scroll 1.

Among them, the elastic member 11 is a wave spring gasket. In another embodiment, the compressor includes a first wear-resistant plate located between the elastic member 11 and the inner wall of the gas-discharge cover 4. The elastic member 11 indirectly contacts the gas-discharge cover 4 through the first wear-resistant plate, thereby preventing wear between the two. In yet another embodiment, the compressor includes a second wear-resistant plate located between the elastic member 11 and the stationary scroll 1. The second wear-resistant plate is located in the receiving groove 107 to prevent wear between the elastic member 11 and the stationary scroll 1. The first wear-resistant plate and the second wear-resistant plate are both made of steel.

Figure 24:
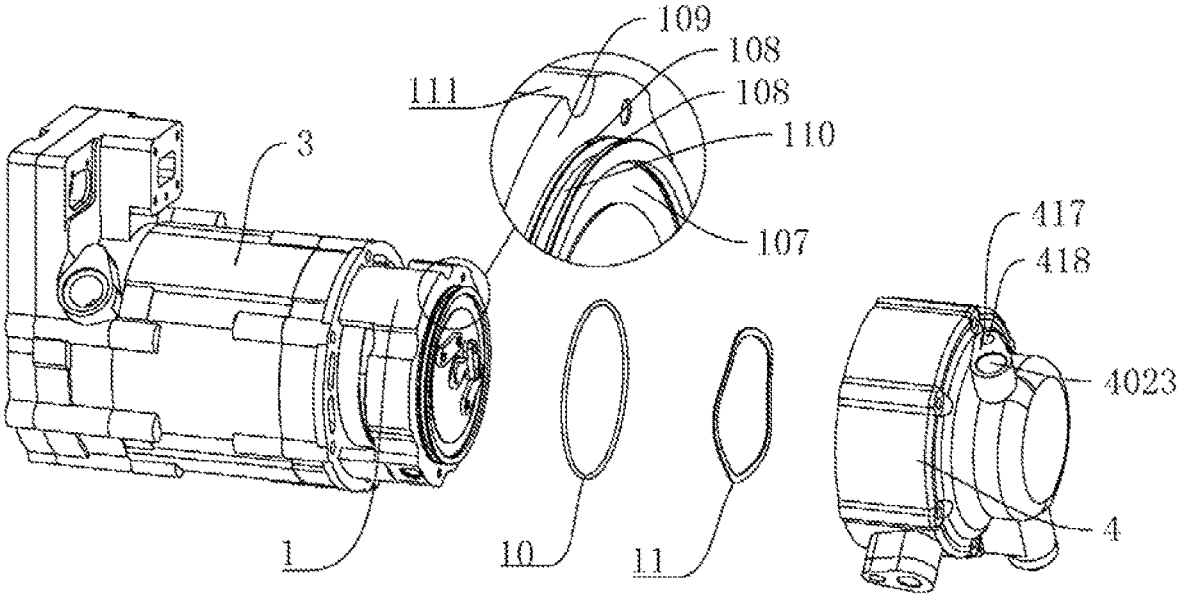
FIG. 24 is an exploded view of a partial structure of the compressor in accordance with an embodiment of the present disclosure.
Figure 25:
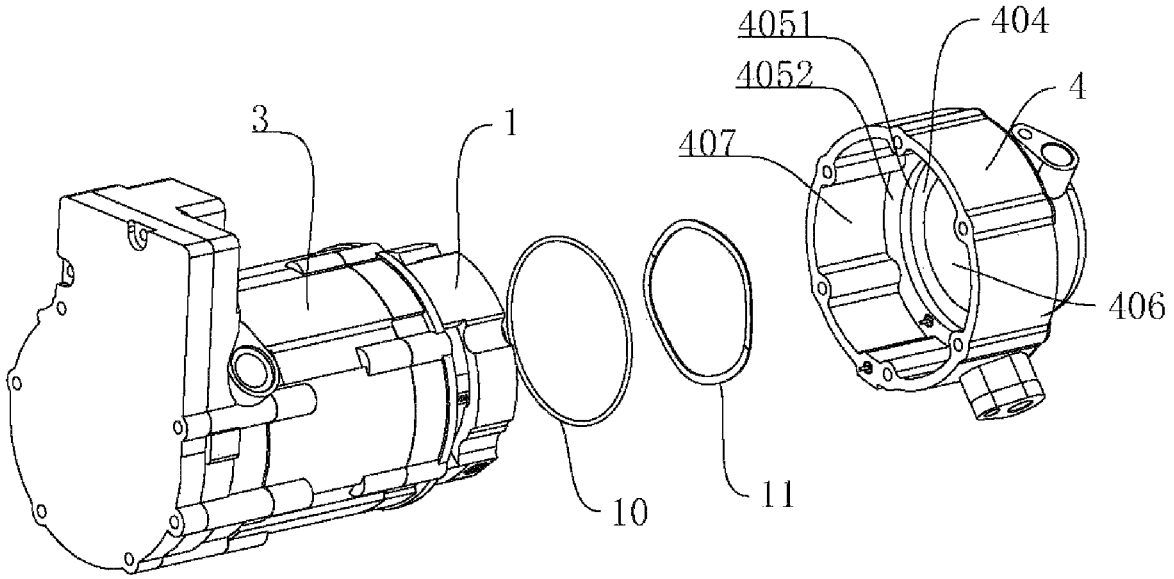
FIG. 25 is an exploded view of partial structures of the compressor in accordance with the embodiment of the present disclosure from another perspective.

As shown in FIGS. 23 to 25, the inner abutment portion 404 includes a boss 405. The boss 405 has a boss peripheral wall 4051. The first spiral wall 101 has a stationary disk peripheral wall 108. The sealing member 10 is in sealing contact with the stationary disk peripheral wall 108 and the boss peripheral wall 4051. The stationary disk peripheral wall 108 defines a sealing groove 110 in which the sealing member 10 is at least partially located.

The boss peripheral wall 4051 has a length in the axial direction. The moving range of the stationary scroll 1 in its axial direction all falls on the surface of the boss peripheral wall 4051. Therefore, when the stationary scroll 1 is displaced, the sealing member 10 can always be in contact with the sealing groove 110 and the boss peripheral wall 4051 so as to always maintain the sealing of the high-pressure chamber 604, and prevent the high-pressure gas in the high-pressure chamber 604 from leaking into the low-pressure chamber 603.

As shown in FIGS. 23 to 25, the boss 405 further includes a first limiting portion 4052 which is in contact with the boss peripheral wall 4051. The first spiral wall 101 further includes a second limiting portion 109 which is in contact with the stationary disk peripheral wall 108. The first limiting portion 4052 is used to limit the second limiting portion 109 in the axial direction of the stationary scroll 1.

When the compressor is not working, the elastic member 11 presses against the stationary scroll 1 to contact the movable scroll 2. At this time, there is a gap between the first limiting portion 4052 and the second limiting portion 109. When the stationary scroll 1 and the movable scroll 2 cooperate for compression, when the pressure in the compression chamber 601 is too large, the stationary scroll 1 can move in its axial direction. This interval provides a space for the stationary scroll 1 to move. At this time, the first limiting portion 4052 can limit the position of the stationary scroll 1 to prevent it from dislocating too much and completely detaching from the movable scroll 2. When the excessive pressure is relieved and the pressure decreases, the elastic member 11 presses against the stationary scroll 1 and returns to an original state to ensure the normal progress of gas compression.

The sealing groove 110 is located at a position of the first spiral wall 101 adjacent to the high-pressure chamber 604. The sealing groove 110 is disposed adjacent to the outer wall of the first spiral wall 101 of the high-pressure chamber 604 to reduce the volume of the high-pressure chamber 604. If the sealing groove 110 is located far away from the high-pressure chamber 604, the volume of the high-pressure chamber 604 will also increase as the sealing groove 110 moves away. If the volume of the high-pressure chamber 604 is too large, it will also affect the pressure of the compressed gas.

Additionally, as shown in FIGS. 24 and 25, the compressor includes a bolt. The main bearing seat 5 and the gas-discharge cover 4 are connected by the bolt. The stationary scroll 1 has a limiting groove 111. The bolt is at least partially located in the limiting groove 111. Since the stationary scroll 1 and the gas-discharge cover 4 are only pressed by the elastic member 11, the stationary scroll 1 and the movable scroll 2 only have a meshing relationship. Under actual working conditions, it is necessary to keep the stationary scroll 1 relatively fixed in its radial and circumferential directions. Through the cooperation between the limiting groove 111 and the bolt, the stationary scroll 1 can be kept fixed in both the radial and circumferential directions. Moreover, the bolt is not only used to limit the position of the stationary scroll 1, but can also be used to connect the main bearing seat 5 and the gas-discharge cover 4, without increasing the use of additional components.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An axially flexible compressor, comprising:

a stationary scroll comprising a first spiral wall;

a movable scroll mating with the stationary scroll; and a gas-discharge cover, the stationary scroll mating with the gas-discharge cover, the stationary scroll being at least partially located in the gas-discharge cover;

wherein the compressor comprises a sealing member and an elastic member; the sealing member is located between an outer side wall of the stationary scroll and an inner wall of the gas-discharge cover; the stationary scroll defines a gas-discharge hole; the outer side wall is located at a position of the first spiral wall away from the gas-discharge hole; the elastic member is located between the gas-discharge cover and a side of the stationary scroll away from the movable scroll; the elastic member abuts against and mates with the stationary scroll and the gas-discharge cover;

wherein the stationary scroll is movable with respect to the movable scroll along an axial direction of the axially flexible compressor between a sealed position where the stationary scroll is abutted against the movable scroll, and an unsealed position where the stationary scroll is separated from the movable scroll;

wherein the axially flexible compressor further comprises:

a shell; and a main bearing seat, the main bearing seat cooperates with the shell to form a low-pressure chamber;

wherein the movable scroll mates with the stationary scroll to form a compression chamber between the movable scroll and the stationary scroll;

the stationary scroll is at least partially located in the gas-discharge cover to form a high-pressure chamber located between the stationary scroll and the gas-discharge cover;

the compression chamber and the high-pressure chamber are in communication with each other through the gas-discharge hole;

regardless of where the stationary scroll is located between the sealed position and the unsealed position, the sealing member always maintains a seal between the outer side wall of the stationary scroll and the inner wall of the gas-discharge cover, thereby ensuring that the high-pressure chamber does not leak a high-pressure refrigerant into the low-pressure chamber;

when the stationary scroll is located at the sealed position, the compression chamber is configured to compress a refrigerant to high-pressure and convey the high-pressure refrigerant into the high-pressure chamber through the gas-discharge hole;

when the stationary scroll is located at the unsealed position, the compression chamber is configured to leak a liquid refrigerant from the compression chamber, thereby reducing pressure in the compression chamber;

wherein the axially flexible compressor further comprises a back-pressure chamber located between the main bearing seat and the movable scroll, and a rotating shaft partially installed on the main bearing seat; the rotating shaft is connected to the movable scroll;

wherein the gas-discharge cover defines a first oil path which is in communication with the high-pressure chamber; the main bearing seat defines a second oil path which communicates the first oil path with the back-pressure chamber;

the rotating shaft defines a third oil path which communicates the back-pressure chamber with the low-pressure chamber;

wherein the movable scroll comprises a second spiral wall to mate with the first spiral wall so as to compress the refrigerant in the compression chamber;

the movable scroll further defines at least one through hole which communicates the compression chamber with the back-pressure chamber; the at least one through hole is disposed adjacent to a root of the second spiral wall.

2. The axially flexible compressor according to claim 1, wherein the stationary scroll comprises a first end plate; the gas-discharge cover comprises an inner abutment portion; the first end plate defines a receiving groove; along an axial direction of the stationary scroll, the receiving groove is at least partially opposite to the inner abutment portion; the elastic member is at least partially located in the receiving groove; the elastic member abuts against and mates with the inner abutment portion and the stationary scroll.

3. The axially flexible compressor according to claim 2, wherein the receiving groove is located away from a center of the first end plate; the gas-discharge cover comprises an inner annular wall and an inner end wall; the inner abutment portion is located on the inner annular wall.

4. The axially flexible compressor according to claim 2, wherein the elastic member is a wave spring gasket which is compressed between the stationary scroll and the gas-discharge cover when the stationary scroll is located at the unsealed position.

5. The axially flexible compressor according to claim 2, wherein the inner abutment portion comprises a boss which has a boss peripheral wall; the first spiral wall has a stationary disk peripheral wall; the sealing member is in sealing contact with the stationary disk peripheral wall and the boss peripheral wall; the stationary disk peripheral wall defines a sealing groove in which the sealing member is at least partially located.

6. The axially flexible compressor according to claim 5, wherein the boss further comprises a first limiting portion connected to the boss peripheral wall; the first spiral wall further comprises a second limiting portion connected to the stationary disk peripheral wall; the first limiting portion is configured to limit the second limiting portion in the axial direction of the stationary scroll.

7. The axially flexible compressor according to claim 5, wherein the compressor defines a high-pressure chamber located between the stationary scroll and the gas-discharge cover; the sealing groove is located at a position of the first spiral wall adjacent to the high-pressure chamber.

8. A compressor, comprising:

a stationary scroll comprising a first spiral wall;

a movable scroll mating with the stationary scroll to form a compression chamber between the movable scroll and the stationary scroll; and a gas-discharge cover, the stationary scroll mating with the gas-discharge cover, the stationary scroll being at least partially located in the gas-discharge cover to form a high-pressure chamber located between the stationary scroll and the gas-discharge cover;

wherein the compressor comprises a sealing member and an elastic member; the sealing member is located between the stationary scroll and the gas-discharge cover; the stationary scroll defines a gas-discharge hole communicating the compression chamber with the high-pressure chamber; the elastic member is located between the gas-discharge cover and the stationary scroll; the elastic member abuts against and mates with the stationary scroll and the gas-discharge cover;

the stationary scroll is configured to be movable along an axial direction thereof, regardless of where the stationary scroll is located, the sealing member always maintains a seal between the stationary scroll and the gas-discharge cover, thereby ensuring that the high-pressure chamber does not leak a high-pressure refrigerant into a low-pressure chamber;

when the stationary scroll moves to a position where the stationary scroll is separated from the movable scroll, the compression chamber is configured to leak a liquid refrigerant from the compression chamber, thereby reducing pressure in the compression chamber;

wherein the compressor further comprises:

a shell;

a main bearing seat cooperating with the shell to form the low-pressure chamber; and a rotating shaft partially installed on the main bearing seat; the rotating shaft being connected to the movable scroll;

wherein a back-pressure chamber is formed between the main bearing seat and the movable scroll;

the gas-discharge cover defines a first oil path which is in communication with the high-pressure chamber; the main bearing seat defines a second oil path which communicates the first oil path with the back-pressure chamber;

the rotating shaft defines a third oil path which communicates the back-pressure chamber with the low-pressure chamber;

wherein the movable scroll comprises a second spiral wall to mate with the first spiral wall so as to compress a refrigerant in the compression chamber;

the movable scroll further defines at least one through hole which communicates the compression chamber with the back-pressure chamber; the at least one through hole is disposed adjacent to a root of the second spiral wall.

9. The compressor according to claim 8, wherein the stationary scroll comprises a first end plate; the gas-discharge cover comprises an inner abutment portion; the first end plate defines a receiving groove; along the axial direction of the stationary scroll, the receiving groove is at least partially opposite to the inner abutment portion; the elastic member is at least partially located in the receiving groove; the elastic member abuts against and mates with the inner abutment portion and the stationary scroll.

10. The compressor according to claim 9, wherein the receiving groove is located away from a center of the first end plate; the gas-discharge cover comprises an inner annular wall and an inner end wall; the inner abutment portion is located on the inner annular wall.

11. The compressor according to claim 9, wherein the elastic member is a wave spring gasket.

12. The compressor according to claim 9, wherein the inner abutment portion comprises a boss which has a boss peripheral wall; the first spiral wall has a stationary disk peripheral wall; the sealing member is in sealing contact with the stationary disk peripheral wall and the boss peripheral wall; the stationary disk peripheral wall defines a sealing groove in which the sealing member is at least partially located.

13. The compressor according to claim 12, wherein the boss further comprises a first limiting portion connected to the boss peripheral wall; the first spiral wall further comprises a second limiting portion connected to the stationary disk peripheral wall; the first limiting portion is configured to limit the second limiting portion in the axial direction of the stationary scroll.

14. The compressor according to claim 12, wherein the sealing groove is located at a position of the first spiral wall adjacent to the high-pressure chamber.

15. A compressor, comprising:

a stationary scroll comprising a first spiral wall and a first wall which are disposed at two opposite sides thereof, the stationary scroll defining a gas-discharge hole extending along an axis direction of the compressor;

a movable scroll comprising a second spiral wall mating with the first spiral wall to form a compression chamber between the second spiral wall and the first spiral wall;

a gas-discharge cover receiving at least part of the stationary scroll therein; a high-pressure chamber being formed between the stationary scroll and the gas-discharge cover;

the gas-discharge hole communicating the compression chamber with the high-pressure chamber;

a sealing ring disposed between the first wall of the stationary scroll and the gas-discharge cover along the axis direction of the compressor; and an elastic spring disposed between the first wall of the stationary scroll and the gas-discharge cover along the axis direction of the compressor;

wherein the sealing ring is further away from the gas-discharge hole than the elastic spring at a radial direction of the compressor;

the stationary scroll is configured to be movable along the axial direction of the compressor; regardless of where the stationary scroll is located, the sealing ring always maintains a seal between the stationary scroll and the gas-discharge cover, thereby ensuring that the high-pressure chamber does not leak a high-pressure refrigerant into a low-pressure chamber;

when the stationary scroll moves to a position where the stationary scroll is separated from the movable scroll, the compression chamber is configured to leak a liquid refrigerant from the compression chamber, thereby reducing pressure in the compression chamber.

* * * * *